US012685386B2

(12) United States Patent
Von Jan et al.

(10) Patent No.: US 12,685,386 B2
(45) Date of Patent: Jul. 21, 2026

(54) APPLICATOR UNIT

(71) Applicant: GEKA GmbH, Bechhofen (DE)

(72) Inventors: Erika Von Jan, Roth (DE); Josef Moser, Unterkulm (CH)

(73) Assignee: GEKA GmbH, Bechhofen (DE)

( * ) Notice: Subject to any disclaimer, the term of this patent is extended or adjusted under 35 U.S.C. 154(b) by 293 days.

(21) Appl. No.: 18/285,216

(22) PCT Filed: Mar. 31, 2022

(86) PCT No.: PCT/EP2022/058639
§ 371 (c)(1),
(2) Date: Sep. 29, 2023

(87) PCT Pub. No.: WO2022/207831
PCT Pub. Date: Oct. 6, 2022

(65) Prior Publication Data

US 2024/0180320 A1 Jun. 6, 2024

(30) Foreign Application Priority Data

Mar. 31, 2021 (EP) ..... 21166408

(51) Int. Cl.
*A46B 9/02* (2006.01)
*A46D 1/00* (2006.01)

(52) U.S. Cl.
CPC ..... *A46B 9/021* (2013.01); *A46B 9/025* (2013.01); *A46D 1/0253* (2013.01); *A46B 2200/1053* (2013.01)

(58) Field of Classification Search
CPC ..... A46B 9/021; A46B 9/025; A46B 9/026; A46B 2200/1053; A46B 2200/1046;
(Continued)

(56) References Cited

U.S. PATENT DOCUMENTS 3,998,235 A 12/1976 Kingsford
4,744,377 A 5/1988 Dolan, Jr.
(Continued)

FOREIGN PATENT DOCUMENTS

BR PI07000294 A 10/2007
CN 107580465 A 1/2018
(Continued)

OTHER PUBLICATIONS

Aurelie Badie, "FR_3024342_B1_translated" (Year: 2014).*
(Continued)

*Primary Examiner* — Edelmira Bosques
*Assistant Examiner* — Holly T. To
(74) *Attorney, Agent, or Firm* — Spencer Fane, LLP

(57) ABSTRACT

An applicator unit includes an applicator and a fluid in the form of a flowable cosmetic or pharmaceutical to be applied to skin or hair, with an applicator organ which stores the fluid in an interior and is configured to distribute the fluid after release thereof, the applicator organ being a hollow body with a wall which delimits the interior and which is formed by a network of locally interconnected ribs, the interconnected ribs being spaced apart from one another, the interior space or the network are matched to the fluid for which the applicator is to apply such that the network retains a certain amount of fluid in the interior after being immersed in and withdrawn from a fluid supply and releases the fluid retained therein to an outside via interstices of the network when the network is deformed on contact with a surface to be treated.

19 Claims, 22 Drawing Sheets

(58) Field of Classification Search
CPC . A46B 2200/106; A46B 5/0025; A46B 11/00; A46B 5/0033; A46B 5/0062; A46B 5/026; A46D 1/0253
USPC ..... 132/218; 401/219, 144, 15, 197, 145, 401/146
See application file for complete search history.

(56) References Cited

U.S. PATENT DOCUMENTS

| | | | | |
|---|---|---|---|---|
| 7,025,068 | B2 * | 4/2006 | Dumler | A46B 9/021 132/218 |
| 8,079,373 | B2 * | 12/2011 | Wyatt | A46B 11/002 132/218 |
| D682,556 | S | 5/2013 | Uresti et al. | |
| 9,532,642 | B2 | 1/2017 | Zech | |
| 10,874,203 | B2 * | 12/2020 | Crapet | A46B 9/021 |
| 11,044,987 | B2 * | 6/2021 | Salciarini | A46B 9/005 |
| 11,197,529 | B2 * | 12/2021 | Sanchez | A46B 9/021 |
| 11,937,689 | B2 * | 3/2024 | Crapet | A46B 5/0029 |
| 2002/0005209 | A1 * | 1/2002 | Gueret | A45D 40/267 132/218 |
| 2005/0217691 | A1 * | 10/2005 | Petit | A46B 9/021 132/320 |
| 2017/0020266 | A1 * | 1/2017 | Sanchez | A46B 9/005 |
| 2017/0360185 | A1 | 12/2017 | De Bardonneche | |
| 2019/0298050 | A1 * | 10/2019 | Berhault | A45D 40/265 |
| 2020/0187634 | A1 | 6/2020 | Berhault et al. | |
| 2024/0122332 | A1 * | 4/2024 | Fogueteiro | A45D 40/262 |
| 2024/0122333 | A1 * | 4/2024 | Fogueteiro | A45D 34/046 |
| 2024/0292941 | A1 * | 9/2024 | Crapet | A46B 9/021 |

FOREIGN PATENT DOCUMENTS

| | | | | |
|---|---|---|---|---|
| FR | 3024342 | A1 | 2/2016 | |
| FR | 3024342 | B1 * | 3/2018 | A45D 34/045 |
| WO | WO-2015083068 | A1 * | 6/2015 | A46B 9/021 |
| WO | 2017115022 | A1 | 7/2017 | |
| WO | WO-2018109122 | A1 * | 6/2018 | A45D 40/265 |
| WO | 2021105411 | A1 | 6/2021 | |
| WO | WO-2025119871 | A1 * | 6/2025 | A46B 9/021 |
| WO | WO-2026008422 | A1 * | 1/2026 | A45D 34/04 |

OTHER PUBLICATIONS

European Search Report issued in corresponding European Application No. 21166408.
International Search Report and Written Opinion issued Jul. 1, 2022 in corresponding International Application PCT/EP2022/058639.
European Office Action issued in corresponding European Application No. 21166408.1.

* cited by examiner

APPLICATOR UNIT

CROSS-REFERENCE TO RELATED APPLICATION

This application is a U.S. National Stage application of International Application No. PCT/EP2022/058639, filed Mar. 31, 2022, which claims priority to European Application No. 21166408.1, filed Mar. 31, 2021, the contents of each of which are hereby incorporated by reference.

BACKGROUND

Technical Field

The disclosure relates to an applicator unit and to a cosmetic or pharmaceutic unit.

Background Information

Conventional applicators can be used to apply makeup or other fluids such as pharmaceuticals to the skin, hair or mucuous membranes, as in the interior of the nose, for example. They are first dipped into the fluid to be applied. In the process, they absorb part of the fluid to be applied with their bristles or their outer circumferential surface. When the applicator is then pulled out of the fluid, it must store the absorbed fluid until it is applied to the desired area with rotating and stroking movements.

SUMMARY

To enable a conventional applicator to absorb and store the fluid to be applied, its outer circumferential surface is typically flocked. This gives the applicator a texture in whose recesses the fluid to be applied is stored depending on its viscosity and surface or interfacial tension. It has been determined that this flocking process is relatively complex and time-consuming. To flock an applicator, the surface to be flocked must first be covered with a layer of adhesive. Then the flock fibers are applied to the wet adhesive and the adhesive has to cure. In addition, flocked applicators can typically only store fluids with a relatively high viscosity. Furthermore, the depressions created by flocking are usually relatively weak. Accordingly, only a thin film of fluid can be absorbed.

In view of this, it is the object of the disclosure to specify an applicator unit whose manufacture is less complicated and with which a larger quantity of the fluid to be applied can be taken up.

According to the disclosure, this problem is solved with the features of the of the applicator unit disclosed herein.

Accordingly, the solution to the problem is provided by an applicator unit comprising an applicator and cooperating with a fluid to be applied thereto to skin or hair, while possessing an applicator organ storing the fluid in its interior. For that purpose it is preferred that the center of the applicator is essentially or even better completely hollow, which in most cases means free from ribs and/or bristles and/or a core.

The fluid for which the applicator unit is provided has the form of a flowable cosmetic or pharmaceutical in some cases including a glue for example for dentist purposes. Eyeliner, serum, concealer, ink and facial oil can be optionally included. In some, not preferred cases also cake-like mascara is included since the user will produce a flowable cosmetic mass before starting the application process. Whatsoever it has preferably low viscosity, for example in the range up to 1.000 mPas. Ideally it has a viscosity of 0.2 to 150 mPas to be determined with the outlet cup, in the optimum case of 0.5 to 75 mPas. In some particular other fields of potential applicability the viscosity ranges from 4.000 mPas to 15.000 mPas. In just other application fields there is a viscosity of 0.2 to 10.000 mPa, in optimum case from 0.5 to 2.000 mPa.

The applicator organ is used to distribute the fluid after it has been released. The applicator organ is a hollow body with a wall surrounding its interior. The wall is formed by a preferably cage-like network of locally interconnected and otherwise spaced ribs.

Not only but typically a "cage like network" means that all ribs that are used to form the said cage body are linked at their both ends to another neighboring rib. That means that those ribs that form the cage body are no ribs having a free end. Preferably none of the ribs has a free end. This is notwithstanding the fact that there can be additional bristles which form bodies having—at least along the majority of their longitudinal extension—a smaller diameter or average diameter than the ribs.

The applicator unit is characterized in that the interior space, the network, and the fluid are matched such that the network retains a certain amount of fluid in its interior space at room temperature after its immersion in and withdrawal from a fluid supply. Preferably, the fluid is retained by capillary action and/or surface tension. The retained fluid, or a predominant portion thereof, is discharged to the outside via the interstices of the network. The release occurs essentially when the network is deformed upon contact with the surface to be treated. With other word: Preferably the cage is designed to be so elastic, that it discharges—at least when being filled by more than 10% or better by more than 25% of its interior volume—the major part of its filling.

Accordingly, in an applicator unit according to the disclosure, flocking of the outer circumferential surface of the applicator is no longer required in order to be able to store the fluid to be applied. In addition, since the fluid-receiving applicator organ is hollow on the inside, a significantly larger quantity of fluid to be applied can be picked up and stored. Due to the capillary action or the surface tension and the interfacial tension in the interior of the applicator organ, fluids of significantly lower viscosity can also be picked up than with the flocked applicators described in the prior art.

At this point it is worth to be mentioned that the disclosure does not mandatorily require an additional flocking and the use of glue coming along therewith so that environmental compatibility is improved.

To apply the fluid stored inside the applicator organ, the applicator organ is pressed against the desired application surface or cavity, like a nose hole. This causes a deformation of the applicator organ, as a result of which a part of the fluid flows out of the applicator organ via the interstices of the network. In addition, an interfacial tension is then established between the stored fluid and the applicator surface, which ensures that the fluid flows in the direction of the surface. Subsequently, the applicator organ can be used to spread the fluid.

In other, alternative application cases the applicator organ is essentially rigid, the issue or "release" of the stored liquid is then accomplished my influencing the capillary holding capacity during application process.

The term "applicator unit" refers to an applicator preferably, but not exclusively, in the form of an eyelash brush or eyelash brush together with a stem and handle.

The term "applicator" refers to the part of the applicator unit without the handle or stem.

The "applicator organ" describes the section of the applicator which receives the fluid to be applied and with which the fluid is applied. Ideally, the applicator organ follows the section of the applicator intended for connection to the stem.

The "fluid" is ideally, but not exclusively, mascara. The disclosure can also be useful for eyeliner, serum, make-up or oil, for example.

There are a number of ways in which the disclosure can be designed to further improve its effectiveness or usefulness.

Thus, it is particularly preferred that the ribs of the applicator organ outside their nodal points have predominantly, better substantially and ideally everywhere, a cross-section or an average cross section of less than or equal to 4.0 mm^2 or even better to 2.25 mm^2 (note: here and in the following mm^2 stands for $mm^2$ which is difficult to be properly recognized by OCR). The cross-section is measured perpendicular to the local longitudinal axis of the ribs. The average cross section is the cross section of the biggest circle that can be inscribed into a potentially non-round cross section of a rib. Preferably, they even have only a cross-section perpendicular to their local longitudinal axis of less than or equal to 1.44 mm^2, the nodal points of the ribs being the areas where they are connected to one or more other ribs. Preferably, the ribs are predominantly or substantially or completely all such that their free length between their nodal points is greater than 1.5 times or preferred greater than 2.5 times their mean rib diameter. Better still, the free length of the ribs between their nodal points is greater than 3.5 times their mean rib diameter. Ideally, the openings between the ribs are predominantly or substantially everywhere such that their clear area is greater than 4 mm^2.

The small cross-sections of the ribs and in particular also the ratio of free rib length to rib diameter ensure good elasticity of the applicator organ and accordingly easier application of the fluid to the desired location.

The clear area of the openings of, in most cases at least 2.5 mm^2, better at least 4 mm^2 ensures that the fluid inside the applicator organ does not escape as a result of surface and interfacial tension before the applicator organ is in contact with a surface or is pressed against a surface. In most cases the clear area of the openings is smaller than 10 mm^2, better smaller than 7 mm^2.

In some application cases the clear area of the openings is at least 1.0 mm^2.

The "free length" of a rib refers to the area between two nodal points.

The "mean" rib diameter denotes the diameter that a circle with the corresponding area would have. In the case that a rib does not have a constant cross-section along its free length, the mean diameter also denotes the cross-sectional diameter averaged over the corresponding free length.

The "clear area" of an opening means the area of an opening lying in a plane bounded by the ribs adjacent to the opening.

In a further preferred embodiment, the network of ribs forming the applicator organ is designed to deform under bending load. The deformation is possible due to the fact that all or at least some of the ribs of the network pivot elastically about their nodal points, by which they are connected to adjacent ribs.

This enables the applicator organ to bend when pressed against a surface.

Ideally, the network of ribs forming the applicator organ is designed in such a way that, under bending load, it can be pushed together in an accordion-like manner on its compression side and pulled lengthwise in an accordion-like manner on its tension side.

As a result, the fluid inside the applicator organ is forced out in the area of the apex of the convex applicator organ formed in this way and applied to the desired surface or structure.

Preferably, the network forming the applicator organ has ribs running spirally from the distal end towards the proximal end of the applicator organ, at least in sections relative to the longitudinal axis L of the applicator organ. The ribs are elastically deformed by contact with the surface to be treated in such a way that their spiral angle increases. As a result, the retention capacity of the applicator organ is changed in such a way that at least part of the retained fluid is discharged to the outside.

By increasing the spiral angle of the ribs, the associated openings between the ribs also increase. As a result, the surface tension of the fluid is no longer sufficient to retain the fluid inside the applicator organ.

The "distal end" of the applicator organ is the end facing away from the stem of the applicator unit or the area of the applicator intended for coupling with the stem.

The "proximal end" of the applicator organ is the end facing the area of the applicator intended for coupling with the stem.

The longitudinal axis of the applicator organ is the axis of the applicator organ passing through the distal and proximal ends.

In another preferred embodiment, at least a portion of the ribs forming the network has a longitudinal rib axis that has a spiral angle with respect to the longitudinal axis L of the applicator organ. More preferably, substantially all of the ribs forming the network have a longitudinal rib axis that has a spiral angle with respect to the longitudinal axis L of the applicator organ.

The spiral course of the ribs has a positive effect on the dispensing behavior of the applicator organ. Thus, the spiral structure causes a deformation to occur due to pressure on the tip of the applicator organ, which triggers a release of fluid.

In a further preferred embodiment, at least at its distal end, preferably at both ends, the applicator organ forms a network in the manner of a cage closed at the end concerned by ribs converging towards the longitudinal axis L, converging towards each other and finally merging with each other. Preferably, the network has the shape of a pointed basket which ideally has a release pin at its tip. It is particularly advantageous if the openings between the ribs become smaller and smaller towards the tip. In this way, the delivery of fluid can also be controlled by whether the applicator organ is held in such a way that its longitudinal axis L is aligned vertically or deviates more or less from the vertical.

The tip or release pin of the cage can be used to spread or draw lines of the fluid already applied. The decreasing openings can be used to precisely apply a small amount of fluid to the desired area. In addition, this results in an increasing flexural rigidity of the applicator organ towards the release pin, which is also beneficial for precise application.

Ideally, the applicator organ has main ribs. The main ribs extend from the proximal end to the distal end of the applicator organ across multiple nodal points. Their average diameter is greater than the average diameter of the connecting ribs, which extend only from a nodal point at one main rib to a nodal point at an adjacent main rib. Preferably, the diameter or mean diameter of the main ribs is at least a factor of 1.3 larger than the diameter or mean diameter of the connecting ribs.

The bending stiffness of the applicator organ is then primarily influenced by the main ribs. The connecting ribs, on the other hand, primarily determine the size of the opening between the ribs and thus regulate the volume flow exiting the applicator organ.

Preferably, the surface of the ribs of the applicator organ has a roughness or texture that can be seen with the naked eye and/or felt with the fingernail when "scratching" along the clean rib.

The roughness of the surface of the ribs causes a higher interfacial tension. Compared to a typical smooth plastic surface, this has a positive effect on the retention capacity of the applicator organ. The retention capacity describes the ability of the applicator organ to prevent the fluid stored inside it from escaping through the openings between the ribs.

In some fields of application it has turned out as being beneficial to provide the interior surface directly confining/being positioned face to face to the cavity of the applicator with a higher surface roughness than the outer surface of the applicator bound to contact the surface to be treated or to be applied to.

In a further preferred embodiment, at least some of the ribs bear bristles that ideally project outward in a substantially radial direction. Preferably, at least the main ribs bear such bristles.

This enables better or more even spreading of the fluid on rough surfaces or on hair. The bristles penetrate into recesses or gaps and distribute the fluid there as well. When using the applicator unit to apply mascara, this results in the desired effect of more voluminous appearing eyelashes.

In a further preferred embodiment, the wall of the applicator organ has an outer diameter equal to or substantially equal to the outer diameter of the adjoining stem. The wall of the applicator organ is thereby formed by a preferably cage-like network of locally interconnected, otherwise spaced ribs.

This is advantageous if a stem wiper is to be provided. The substantially equal diameters prevent excessive stripping or triggering of the elastic deformation of the applicator organ causing the liquid delivery when passing through the stem wiper.

The "outside diameter" of the wall means its outside diameter without taking into account any bristles.

Preferably, the wall forms a spherical shape.

With a correspondingly small rib cross-section, a sphere can be deformed reversibly and elastically in such a way that it reveals its contents. The spherical shape also permits particularly strong elastic deformations, which return of their own accord after relief. The spherical shape is thus associated with an increased fluid release capacity.

In another preferred embodiment, the applicator organ consists of a cage-like network having the overall appearance of a ball, a plum, an ellipsoid or a kidney bean. These shapes are well rounded and are therefore preferred for applicators that have to be introduced into a body hole in particular a nose hole in order to apply a pharmaceutical agent.

In a further preferred embodiment, the applicator organ consists of several cage-like networks (preferred of the aforementioned shape) that are hydraulically essentially or completely separated from one another. Preferably, the applicator organ consists of an elongated, usually plum-shaped cage and a spherical cage ideally adjoining it at the distal end.

This enables the release behavior of the applicator organ to be controlled. For example, one of the cages, ideally the ball, can be designed to be softer than the adjacent cage so that it deforms first and reveals its contents first. Alternatively, the disclosure of the fluid can be controlled depending on the angle of contact with the surface to be treated. In the case of frontal initial contact, the sphere then reveals its contents first; in the case of lateral initial contact, the plum-like cage reveals its contents first.

The "distal" end of the plum-shaped cage is the end facing away from the stem of the applicator unit.

A "plum-like" shape means an ellipsoid or a double pyramid with ideally rounded edges and possibly rounded vertices. A double pyramid is a polyhedron formed by a pyramid whose base is glued to the base of its mirror image.

Ideally, the applicator organ consists entirely or essentially or sectionally of ribs in the form of circular rings, oval rings or polygonal rings. The rings are connected to each other at their outer circumferences via nodal points.

It is both conceivable that the rings are arranged as bristles on a closed bristle holder of the applicator running parallel to the longitudinal axis of the applicator. The fluid is then stored in the rings only by surface and interfacial tension. By gently pressing the applicator or rings to the desired location, the rings are then elastically deformed and release the fluid.

Alternatively, the rings can be contiguous to form a cage bounded by them about the longitudinal axis of the applicator. This increases the amount of fluid that can be absorbed.

This disclosure is further directed to an applicator organ having a coupling element for coupling to a stem for an applicator unit.

DETAILED DESCRIPTION

The operation of the applicator unit or applicator organ according to the disclosure is explained with reference to FIGS. 1 to 22. For reasons of clarity, the (main) ribs 8, connecting ribs 9, nodal points 10 and interstices 11 of the individual embodiments are given only exemplary reference signs in all Figures.

Figure 1:
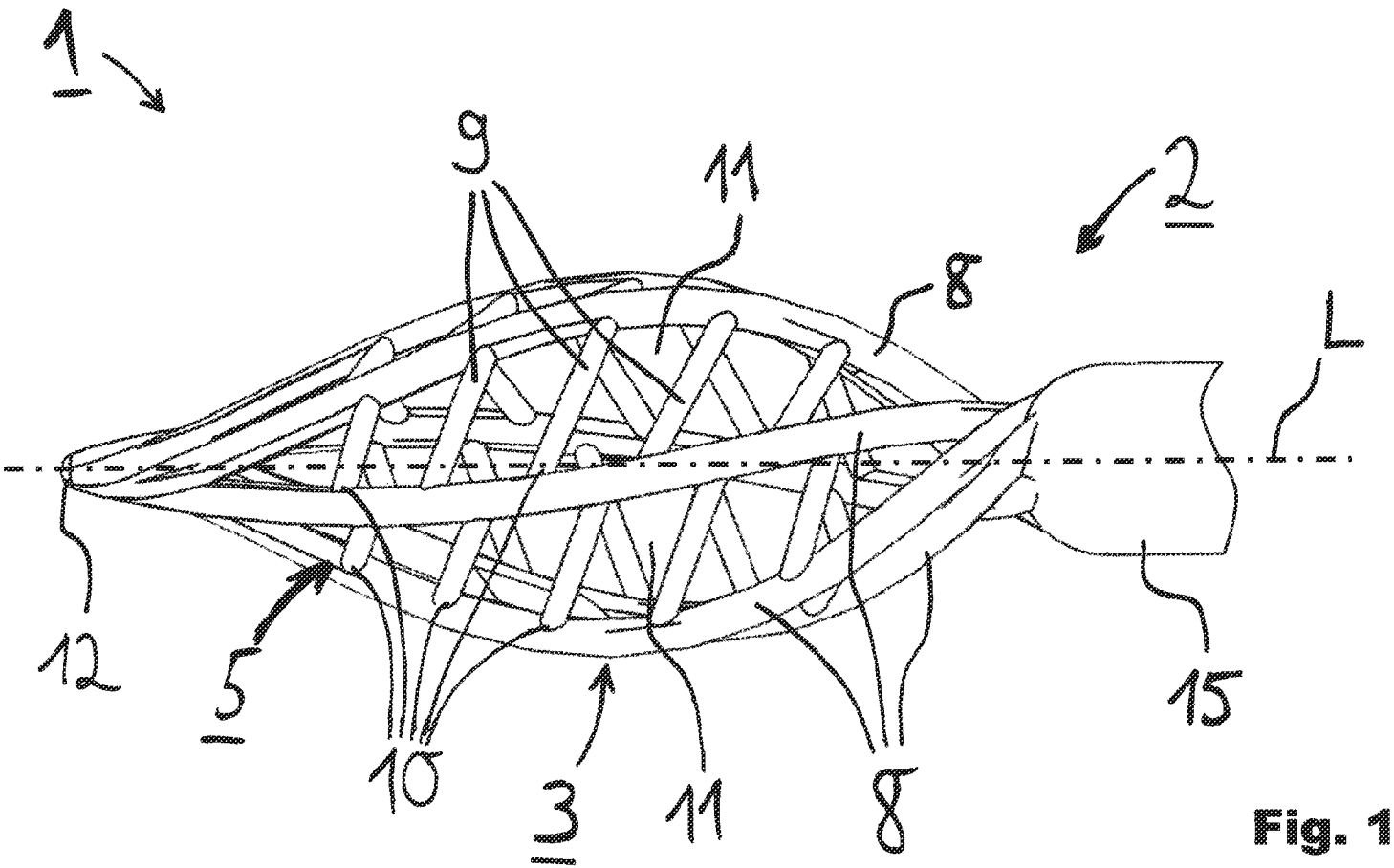
FIG. 1 shows a side view of a first applicator unit.

In FIG. 1, the applicator 2 of an applicator unit 1 is shown in side view. The applicator 2 comprises an applicator organ 3 and a coupling part 15 adjacent thereto. The coupling part 15 can be used to connect the applicator 2 to a stem 4 of the applicator unit 1 not shown in FIG. 1. The applicator organ 3 of the applicator 2 serves to receive a fluid and apply it to the desired location. The applicator organ 3 consists of a wall 5 or a network 5 enclosing a cavity. The network 5 is formed by a plurality of main ribs 8 and a plurality of connecting ribs 9.

The main ribs 8 of the applicator organ 3 extend from the coupling part 15 to the tip 12 of the network 5, with the main ribs 8 merging into one another both in the region of the coupling part 15 and in the region of the tip 12 of the network 5. At the coupling part 15, the main ribs 8 furthermore merge into the coupling part 15. The region of the applicator organ 3 where the main ribs 8 merge into the coupling part 15 represents the proximal end of the applicator organ. The region where the main ribs 8 merge into the tip 12 of the network 5 represents the distal end of the applicator organ 3.

The main ribs 8 run from a point on the longitudinal axis L of the applicator organ 3 in the area of the coupling part 15 to an end point of the network 5, which is also on the longitudinal axis L and represents the tip 12 of the network 5. Between the distal end and the proximal end of the applicator organ, the main ribs 8 do not extend along the longitudinal axis L. Rather, each main rib 8 represents a convex bulge of the network 5. Together, the main ribs 8 here form a plume-like shaped network 5. In addition, each main rib 8 ideally extends in a spiral fashion around the longitudinal axis L of the applicator organ 3.

The connecting ribs 9 each run—mostly all of them—between two main ribs 8, with each connecting rib 9 starting at a nodal point 10 on a first main rib 8 and ending at a nodal point 10 on a main rib 8 adjacent to the first main rib 8.

Both the main ribs 8 and the connecting ribs 9 have an essentially circular cross-section. However, the cross sections of the main ribs 8 are always (in other cases predominantly) larger than the cross sections of the connecting ribs 9.

Between the main ribs 8 and the connecting ribs 9 are the openings 11. These also form the openings 11 of the network 5. Through these openings 11, the fluid can enter or exit the hollow interior of the applicator organ 3.

To fill the applicator organ 3 with the fluid, it is immersed in a container holding the fluid. In the process, the fluid flows through the openings 11 into the interior of the applicator organ 3 as a result of the hydrostatic pressure in the container. In some cases, the applicator organ 3 and the container can be matched to each other in such a way that the applicator organ 3 can be pressed from the inside against the wall of the container in the completely or partially submerged state and thereby deformed in such a way that (additional) fluid can enter the applicator organ 3. However, if the applicator 2 or the applicator organ 3 is now pulled out of the container holding the fluid, the fluid does not flow out of the interior of the applicator organ 3 by itself. This is because the interstices 11 of the network 5 are so small that the combination of surface and interfacial tension prevents the fluid from exiting the interior of the applicator organ 3.

In order to be able to apply the fluid to the desired surface 14, the applicator organ 3 is pressed with its network 5 against the surface 14 to be applied to. In many cases, an elastic deformation of the main ribs 8 and usually also of the connecting ribs 9 takes place. On the one hand, this deformation has the effect that the interstices 11 of the network 5 expand or at least change in the area of the network 5 that is pressed against the surface 14. As a result, the existing surface tension is no longer sufficient to retain the fluid inside the applicator organ 3. In addition, the pressing of the network 5 against the surface 14 and the elastic deformation of the network 5 that occurs in the process establishes contact between the fluid present in an opening 11 located in the pressed-on region of the network 5 and the surface 14. As a result, an interfacial tension also occurs between the surface 14 and the fluid. This pulls out part of the fluid located in the opening 11 when the applicator organ 3 is lifted off.

Figure 2:
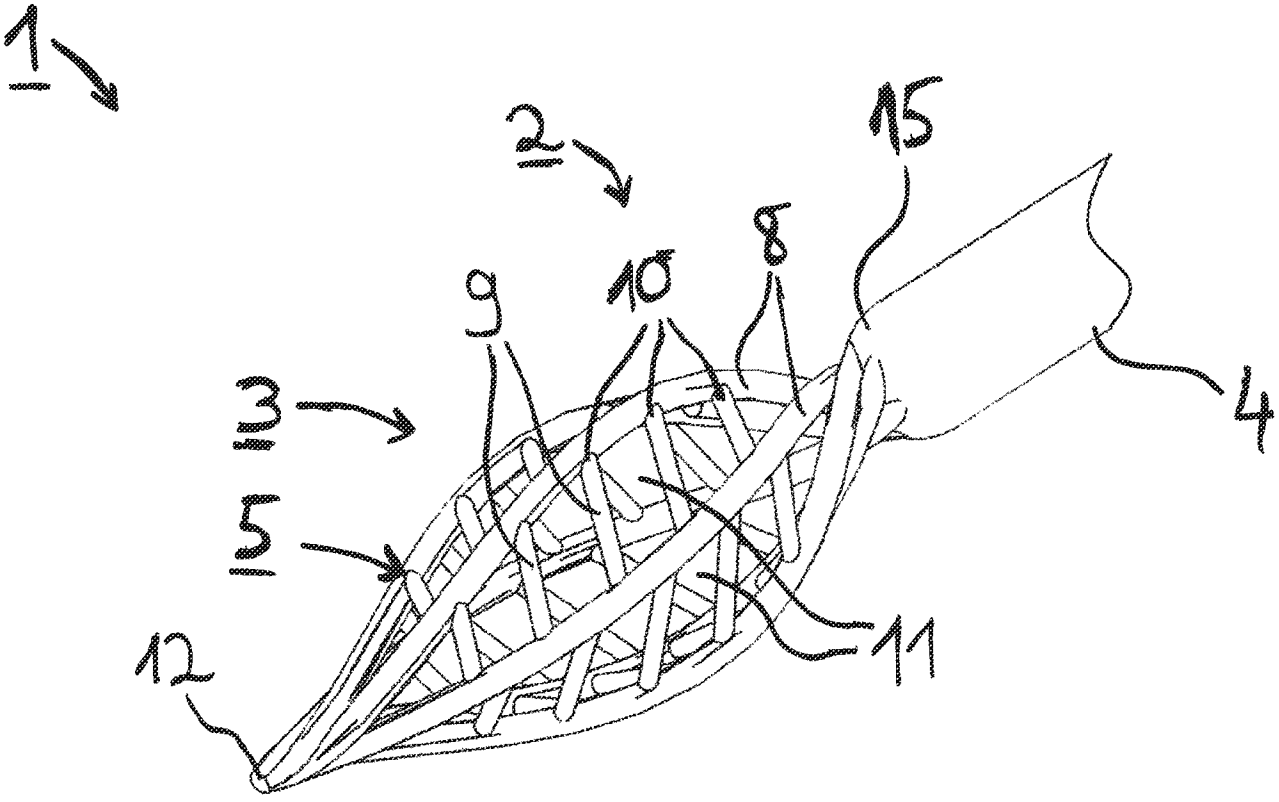
FIG. 2 shows the applicator unit of FIG. 1 in a three-dimensional view.

FIG. 2 shows the applicator unit of FIG. 1 in a three-dimensional view.

Figure 3:
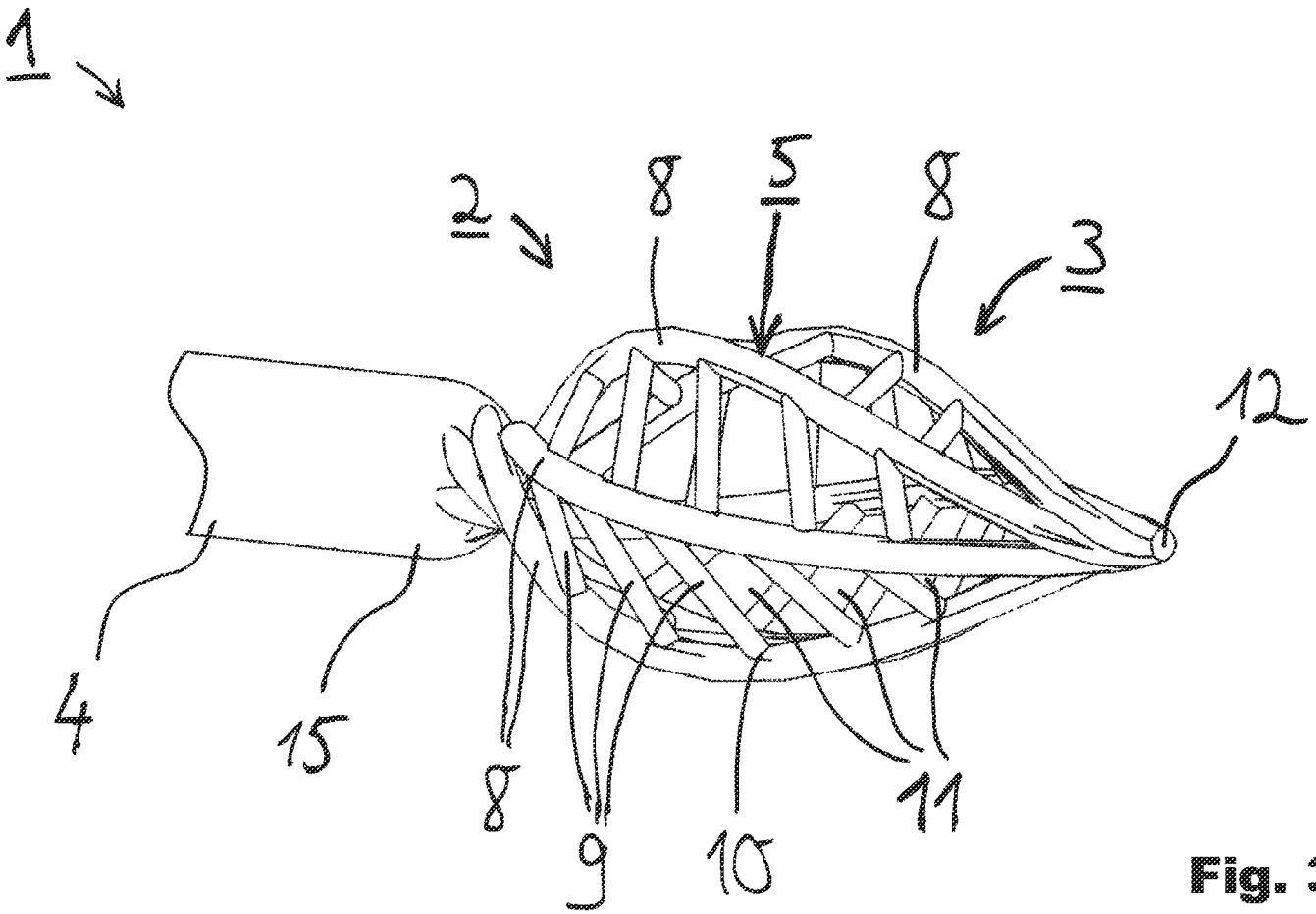
FIG. 3 shows a three-dimensional view of the applicator according to FIG. 1.

In FIG. 3, the applicator unit 1 shown in FIG. 1 is shown in a three-dimensional view. The stem 4 of the applicator unit 1 is also visible. The applicator 2 with its coupling part 15 is attached to the stem 4. On the basis of FIG. 2, the spiral course of the main ribs 8 around the longitudinal axis L of the applicator organ 3 can be clearly seen.

In addition, it is clearly visible how all the main ribs 8 merge into one another in the area of the tip 12 of the network 5. The tip 12 also represents a trigger or triggering pin 12. On the one hand, the trigger pin 12 can be used to distribute fluid already applied to the surface 14 or to draw fine lines through the applied fluid. On the other hand, the applicator organ 3 can be pressed against the surface 14 with its tip 12 substantially orthogonal to it. In this process, an elastic deformation of the network 5 also takes place. This results in a widening of the openings 11, which in turn triggers an escape of the fluid located inside the applicator organ 3. In some cases, the pin 12 can be made so long that it forms a lever arm via which it is easier to achieve a deformation of the network 5 that results in a more than insignificant fluid discharge.

Figure 4:
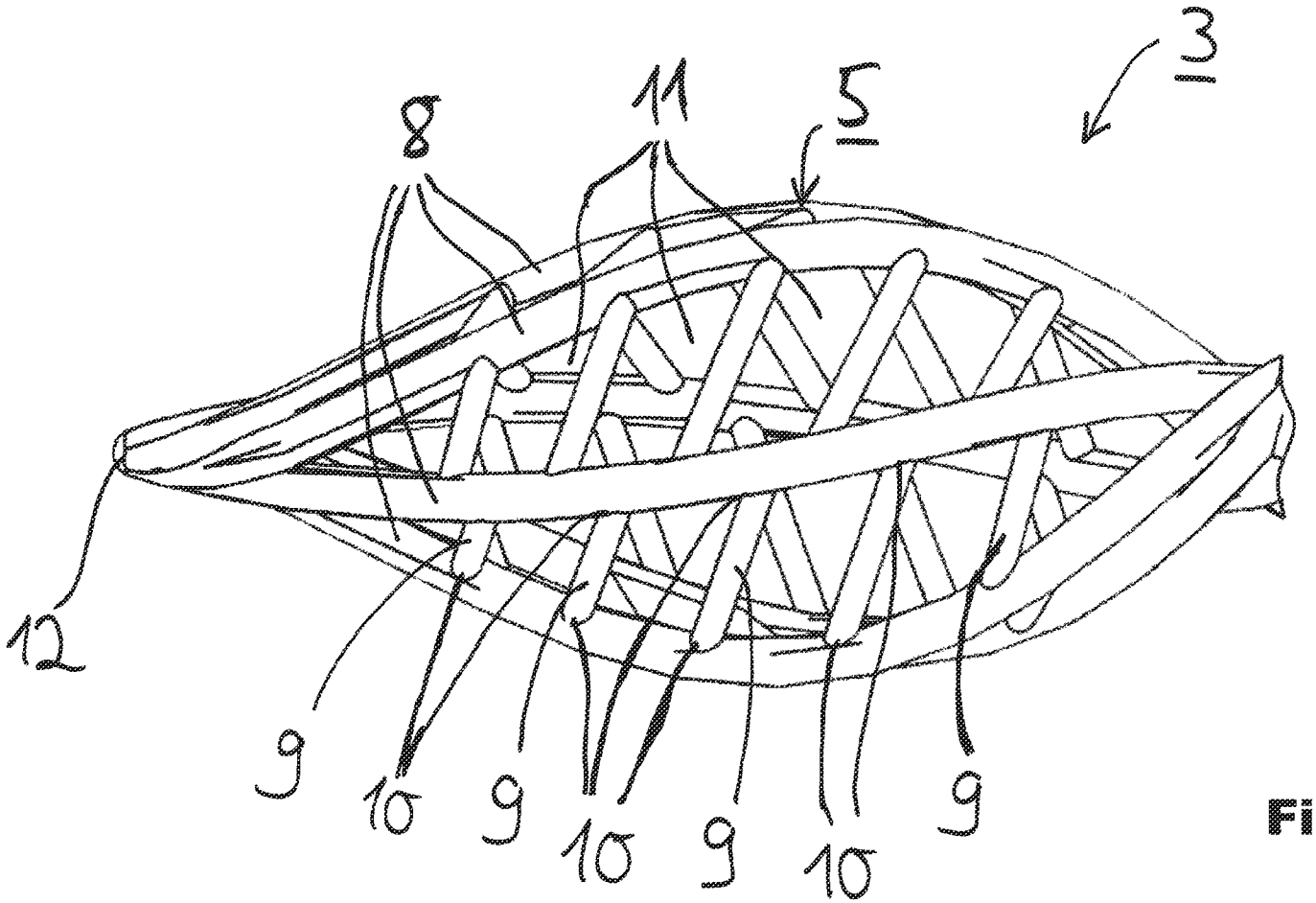
FIGS. 4-6 show various detailed views of the applicator unit shown in FIG. 1.
Figure 5:
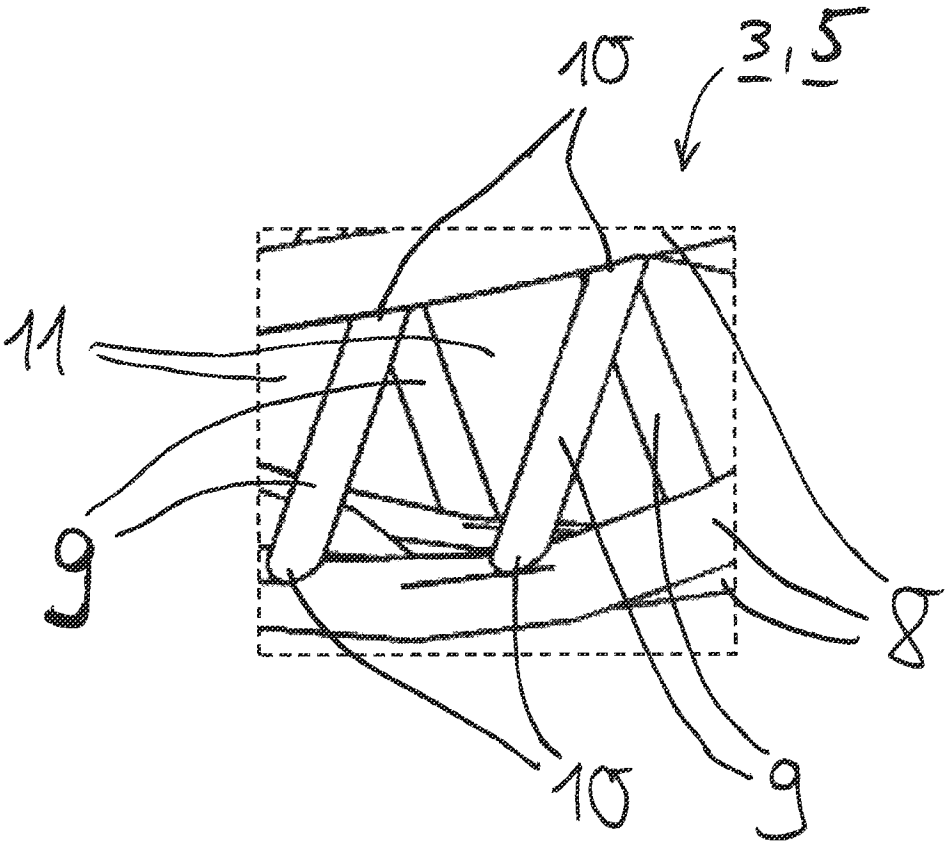
Figure 6:
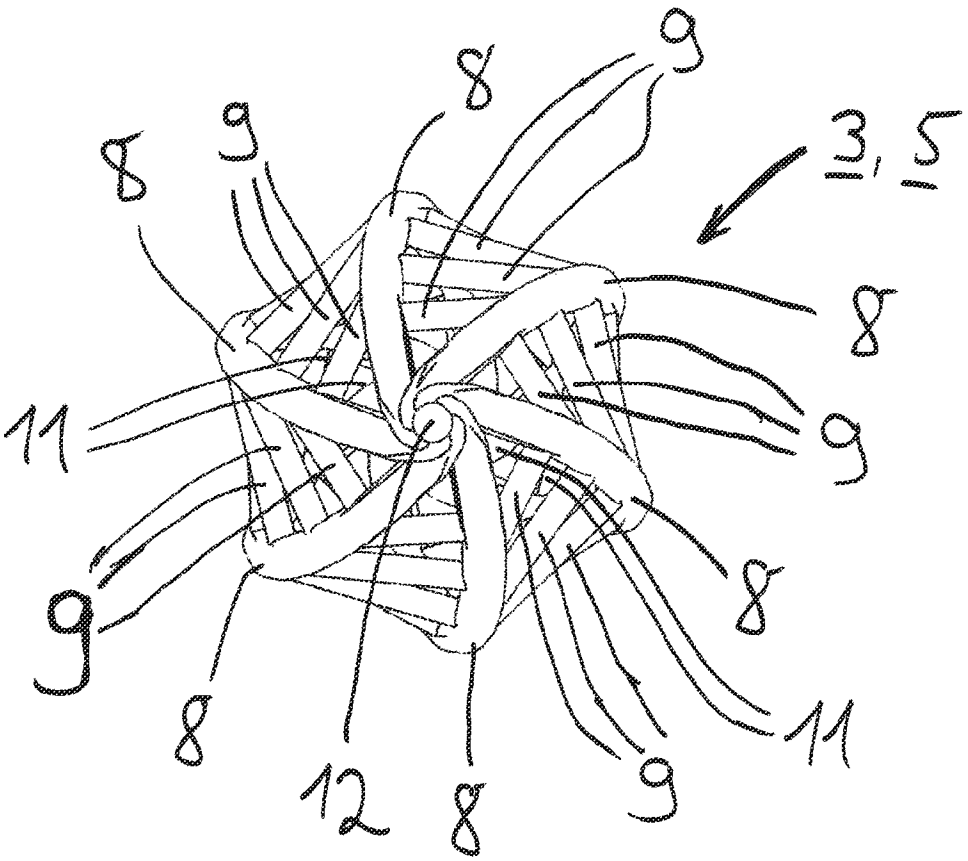

In FIGS. 4 to 6, various areas of the applicator organ 3 are shown in detail. FIGS. 4 and 5 show very clearly the nodal points 10 from which the connecting ribs 9 start.

FIG. 5 also shows that both the main ribs 8 and the connecting ribs 9 have a roughened surface. This ensures that the interfacial tension between the ribs and the fluid also increases. Thus, the fluid is held better inside the applicator organ 3 due to the roughened surface of the main and connecting ribs 8 and 9.

FIG. 6 again clearly shows the spiral course of the main ribs 8.

Figure 7:
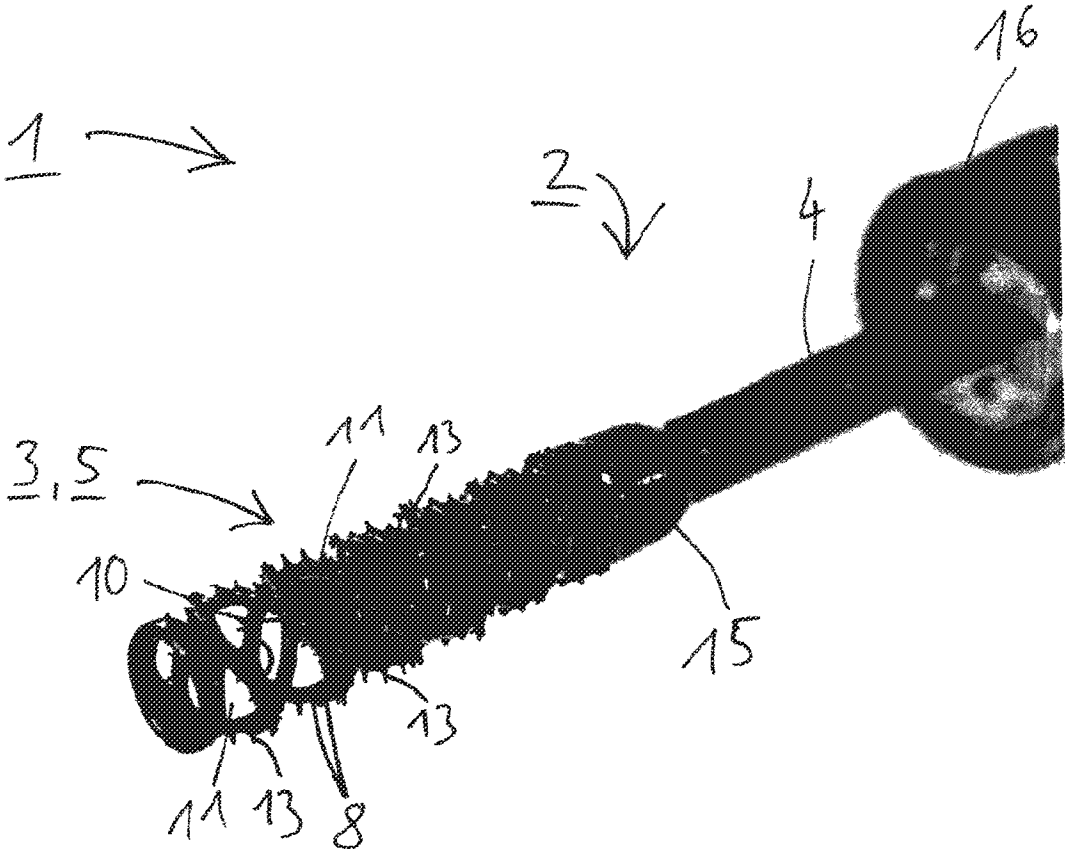
FIG. 7 shows an applicator unit with cylindrical network and bristles.

FIG. 7 shows another example of an applicator unit 1. In this one, the applicator organ 3 is formed by a network 5 with a constant outer diameter and bristles 13. The outer diameter of the network 5 is larger than the diameter of the stem 4, but ideally only minimally, usually only 8% to 15%. The network 5 in this case also consists of ribs 8, although no additional connecting ribs are disposed between the ribs 8. Each rib 8 runs spirally around the longitudinal axis L of the applicator organ 3, which is not shown. In the process, each rib 8 circles the longitudinal axis L several times. Thereby, ribs 8 running in opposite spirals are provided. Two ribs 8 cross each other in the nodal points 10. In the area between the ribs 8 and the nodal points 10, the network 5 includes interstices 11. These open the way into the interior of the applicator organ 3. Ideally, the ribs 8 delimit a circular cylindrical applicator organ 3 with a completely or substantially constant diameter along the longitudinal axis. Preferably, each rib 8 has a plurality of bristles 13 attached thereto. These mostly protrude from the ribs 8 in the radial direction of the applicator organ 3. The diameter of the bristles 13 is usually at least a factor of 5 smaller than the diameter of the ribs 8.

The applicator organ 3 shown in FIG. 7 is open at its end face. When the applicator organ 3 is pulled out of the fluid-filled container, fluid adheres only in the interstices 11 of the network 5 due to interfacial and surface tension. This ensures that less fluid is applied to the surface 14 per application operation. This can be advantageous depending on the application.

In some cases, the amount of fluid released and then applied per application cycle can be controlled by guiding the applicator organ 3 (relative to its longitudinal axis) in a more or less horizontal direction while it is being pulled out of the reservoir and during the actual application curtain.

The stem 4 of the applicator unit 1 shown in FIG. 7 merges into the handle 16 at its end facing away from the applicator 2.

Figure 8:
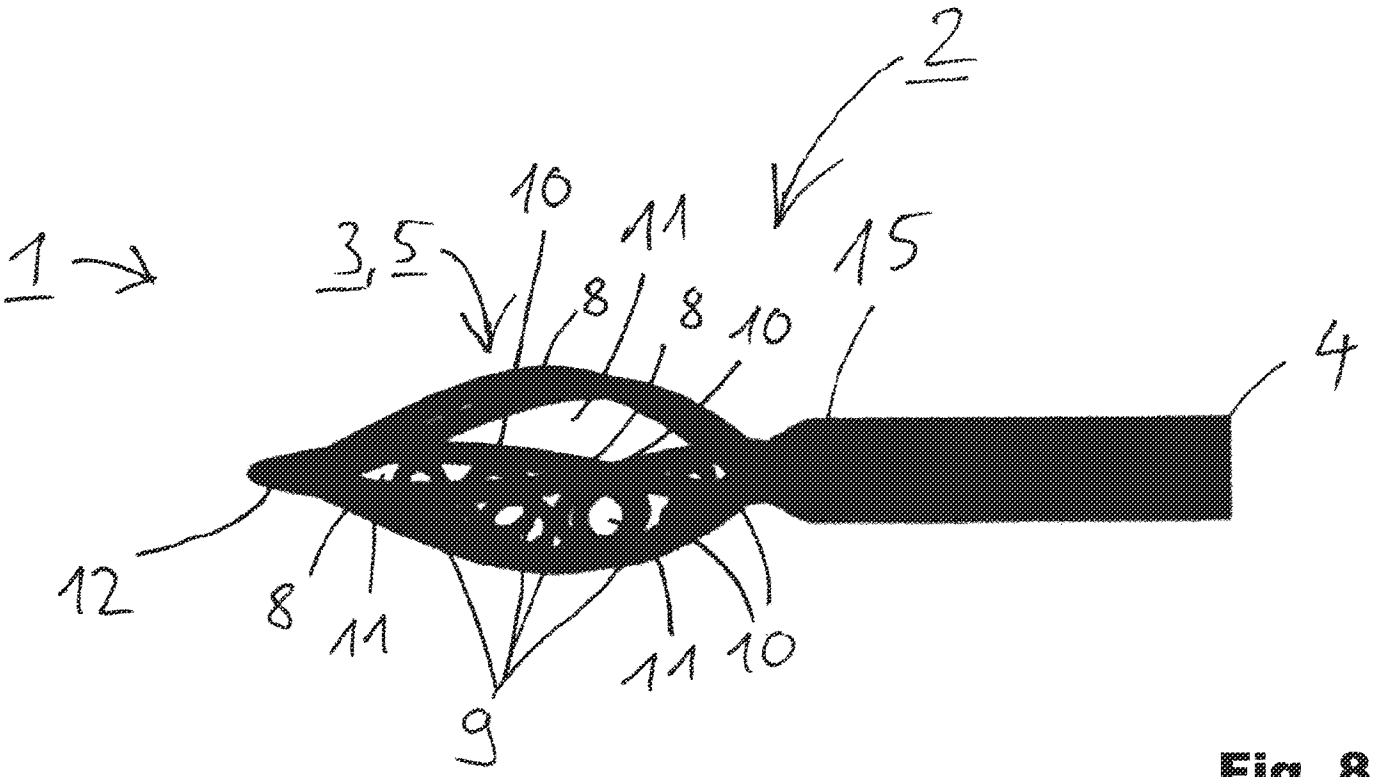
FIG. 8 shows an applicator unit with a network of annular and spiral ribs.

In FIG. 8, another applicator unit 1 is shown. In this one, the applicator organ 3 consists of a preferably plum-like network 5. The network 5, in turn, is formed by the main ribs 8 and the connecting ribs 9. Connecting ribs 9 are disposed between two main ribs 8 on only one half side of the network 5. In this way, the applicator organ 3 can be given a kind of "spoon function" if it has an appropriate design and if the fluid viscosity is set accordingly. As long as such an applicator 2 is pulled out of the reservoir and guided in such an oriented manner as shown in FIG. 8, it will not dispense any fluid, or (when in contact with the target surface) only a reduced amount of fluid, while a predominant amount of fluid is still held in the network 5 of the main 8 and connecting ribs 9 forming a kind of lower half-shell. If the applicator organ 3 is now rotated or tilted a certain amount around or (in the case of tilting) over its longitudinal axis, then an increased amount of fluid is discharged from the inside of the applicator organ to the outside via the area still lying above in FIG. 8, which includes fewer or (as here) no connecting ribs.

The connecting ribs 9 are here preferably circular rings. Each of these circular connecting ribs 9 is tangent to a main rib 8 at two opposite points. In this way, an improved fluid-retaining but still easily deformable network 5 is created, which can therefore be brought to fluid release even with lower forces—even if the ribs 8, 9 are not designed too thin and are therefore relatively robust against unintentional deformations, they do not immediately suffer damage in the sense of permanent deformation. The areas where the connecting ribs 9 are tangent to the main ribs 8 represent the nodal points 10. These are not marked with reference signs in FIG. 8.

Since the network 5 curves convexly around the longitudinal axis L of the applicator organ 3 and all the main ribs 8 extend spirally around the longitudinal axis L, the areas between each two main ribs 8 at the distal and proximal ends of the applicator organ 3 are smaller than in the central area of the applicator organ 3. Accordingly, the circles formed by the connecting ribs 9 also have a smaller diameter in the region of the distal and proximal ends of the applicator organ 3 than in the central region of the applicator organ 3. However, the cross sections of the connecting ribs 9 are ideally all the same size.

Figure 9:
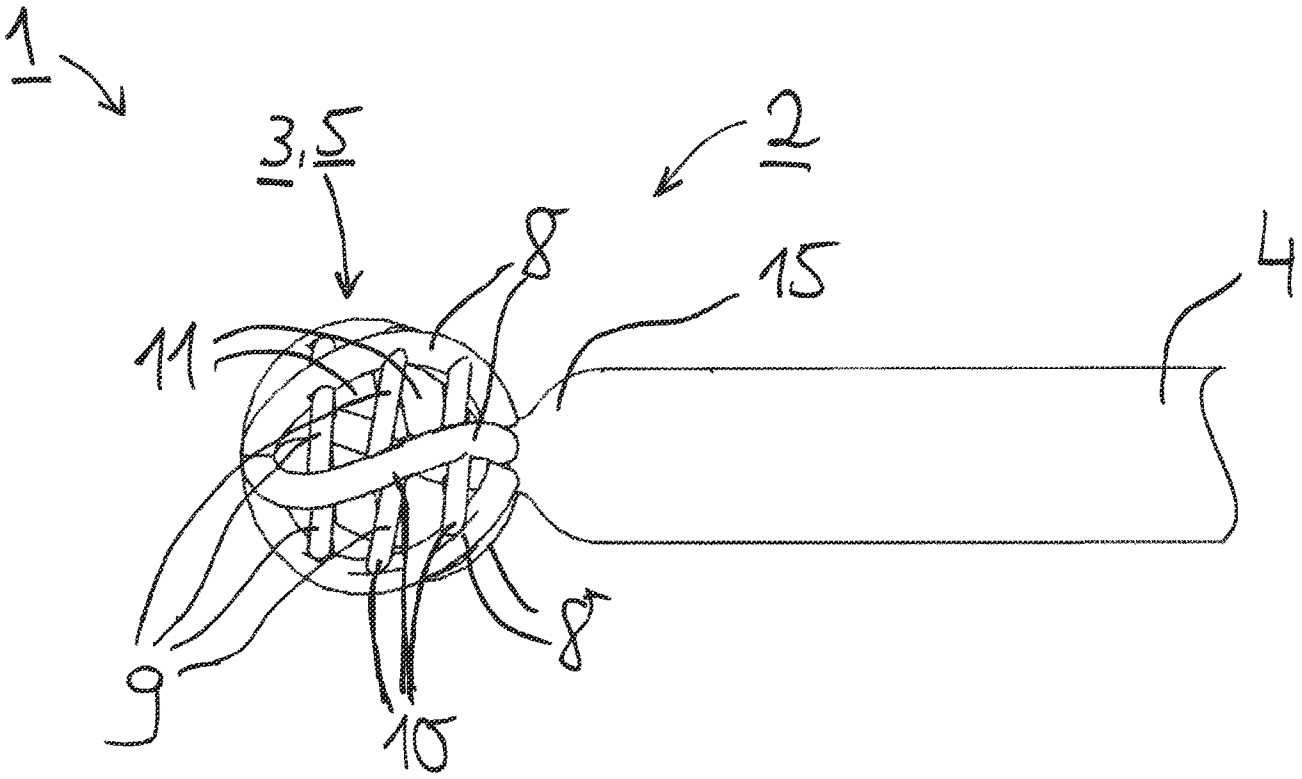
FIG. 9 shows an applicator unit with a circular network.

FIG. 9 shows an applicator unit 1 whose applicator organ 3 has a spherical network 5. The spherical network 5 consists of the main ribs 8 and the connecting ribs 9. The main ribs 8 run from the coupling part 15 of the applicator 2 as spherical spirals to the end of the applicator organ 3 facing away from the coupling part 15. The connecting ribs 9 have a smaller cross-section than the main ribs 8 and each run between two main ribs 8. Each connecting rib 9 starts in a nodal point 10 on a first main rib 8 and ends in a nodal point 10 on a second main rib 9. The nodal points 10 do not include reference signs.

Such a spherical shape (usually corresponding to or essentially approximating the mathematical spherical shape) can be deformed particularly strongly. Nevertheless, it always returns elastically to its original shape. This spherical shape therefore helps to control the delivery via the elastic deformation in a particularly good and user-friendly way. If necessary, a squeezing delivery can also be superimposed, which is particularly interesting for fluids with a higher viscosity, the user can compress the spherical body reversibly and elastically to such an extent that the volume enclosed by the spherical body is reduced to such an extent that the fluid to be dispensed is forced out and is not just dispensed by changing the surface tension and/or capillarity.

This spherical shape is aiming to be used for skin treatment. The user is able to hold the applicator intuitively. No need to align the shape according the application area.

It can be particularly attractive to equip the spherical body according to FIG. 9 with the "spoon function" explained on the basis of FIG. 8 by corresponding ribbing, which is not shown in FIG. 9, as will be explained below by way of example only.

Figure 10:
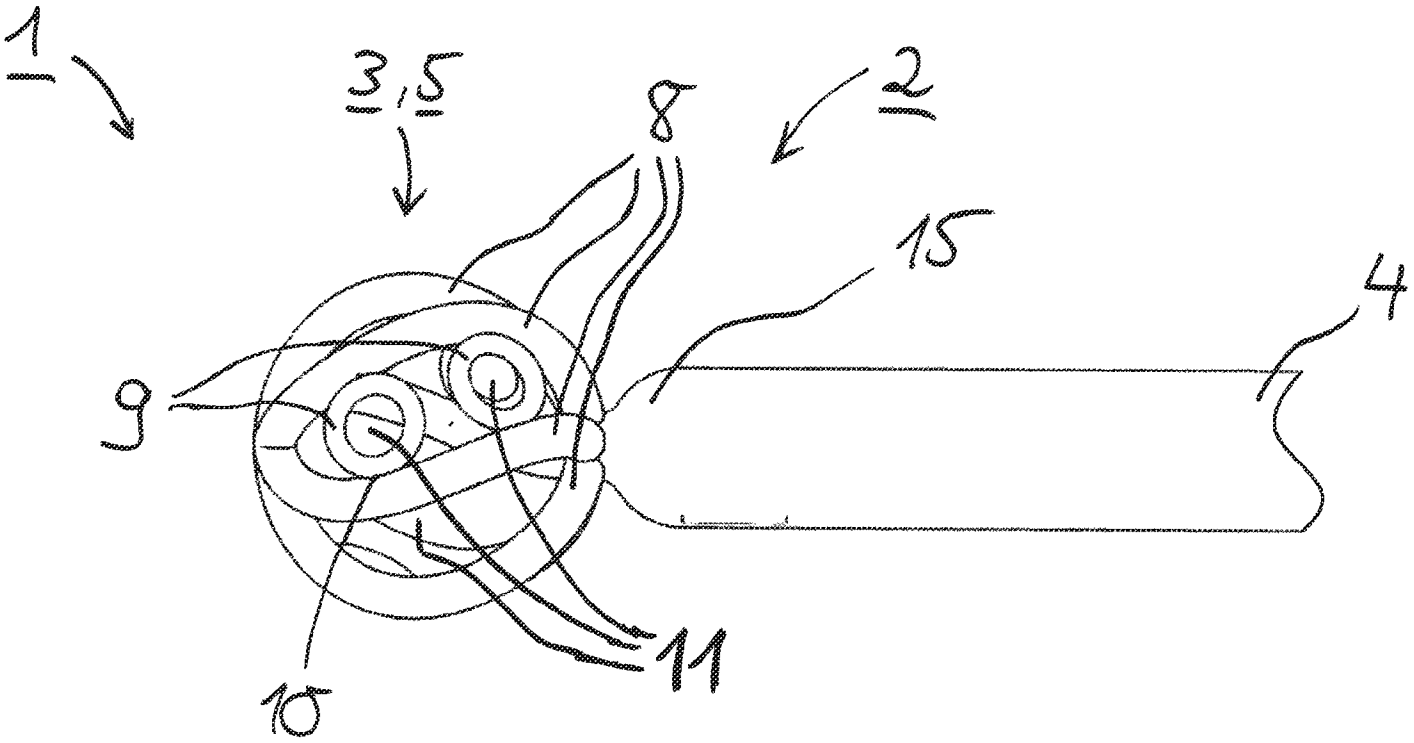
FIG. 10 shows another applicator unit with a circular network.
Figure 11:
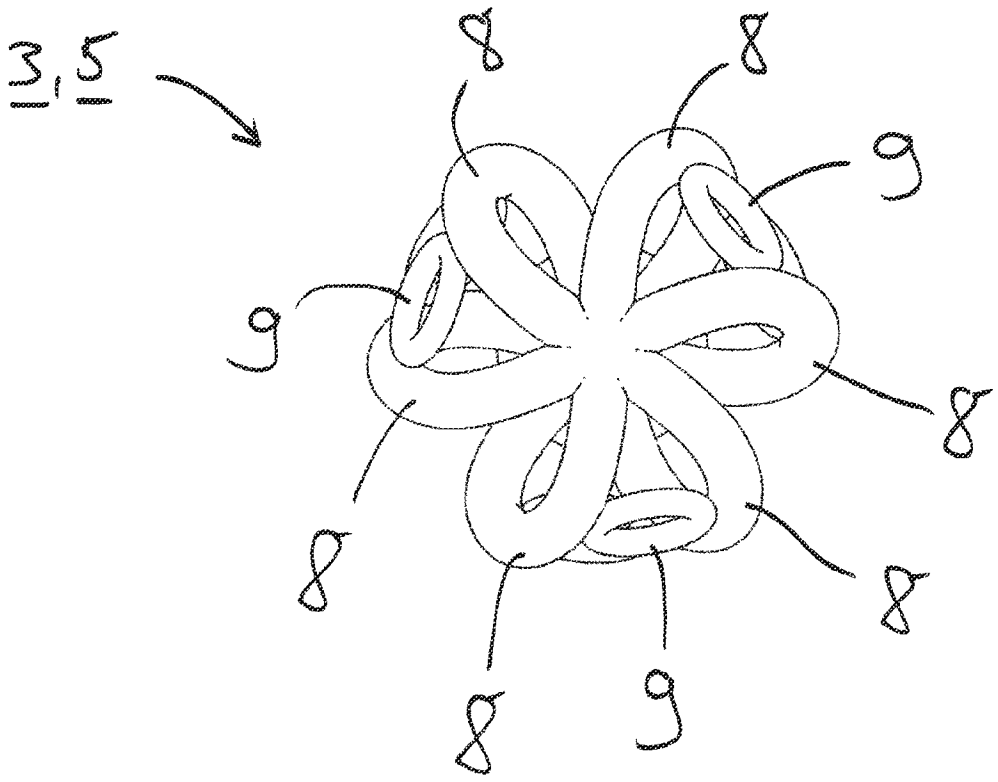
FIG. 11 shows a plan view of the applicator unit according to FIG. 10.

FIG. 10 shows an applicator unit 1 which also has an applicator organ 3 with a spherical network 5. Here, too, the network 5 consists of main ribs 8 running as spherical spirals and connecting ribs 9. The connecting ribs 9 are circular rings, each of which is tangent to a main rib 8 at two opposite points. However, connecting ribs 9 are not disposed between all adjacent main ribs 8. Rather, two adjacent main ribs 8 are alternately connected with connecting ribs 9, and the next two main ribs 8 are not. This can be clearly seen in FIG. 11, which shows a top view of the applicator 2 shown in FIG. 10.

Figure 12:
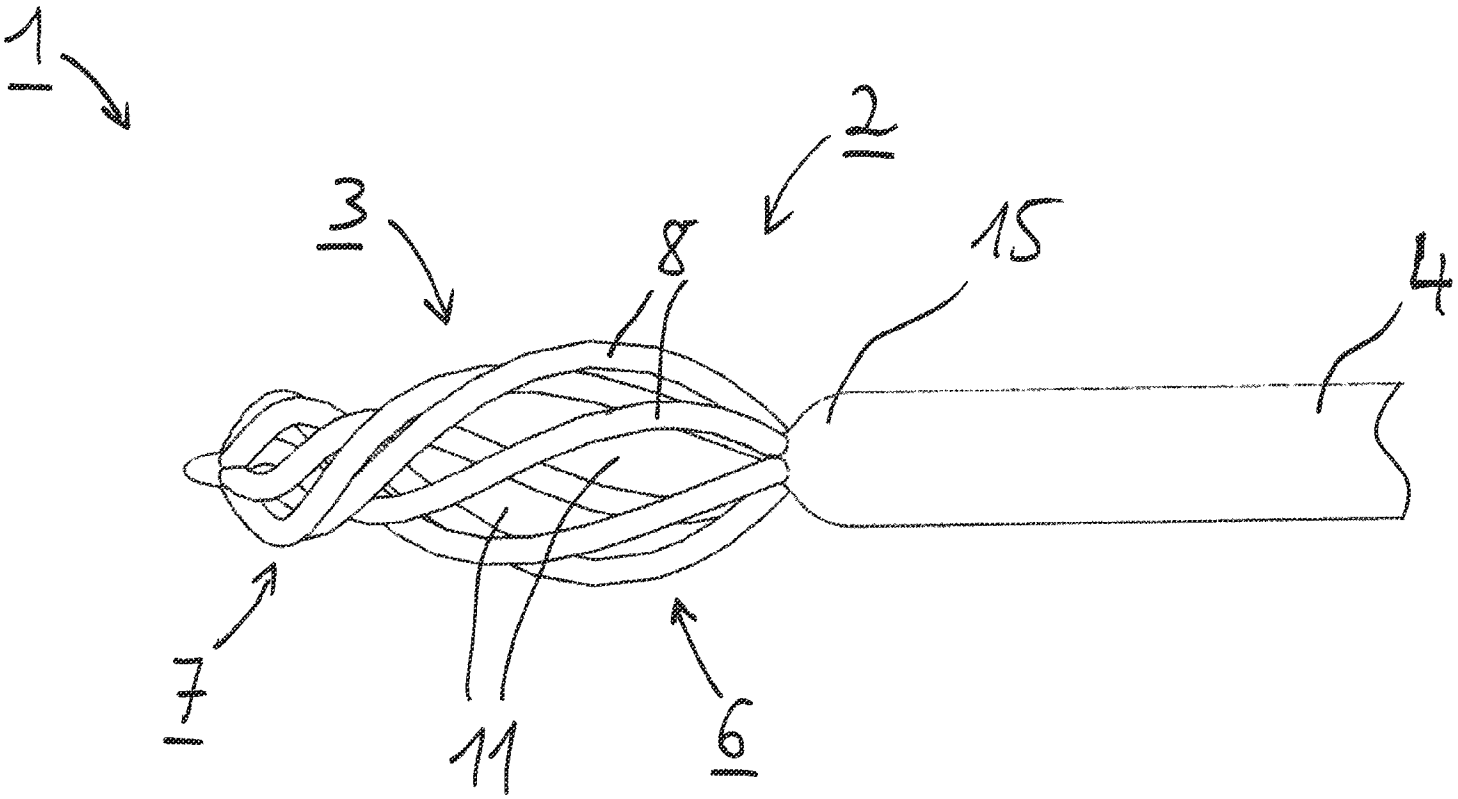
FIGS. 12-14 show various applicator units, each with two interconnected networks.
Figure 13:
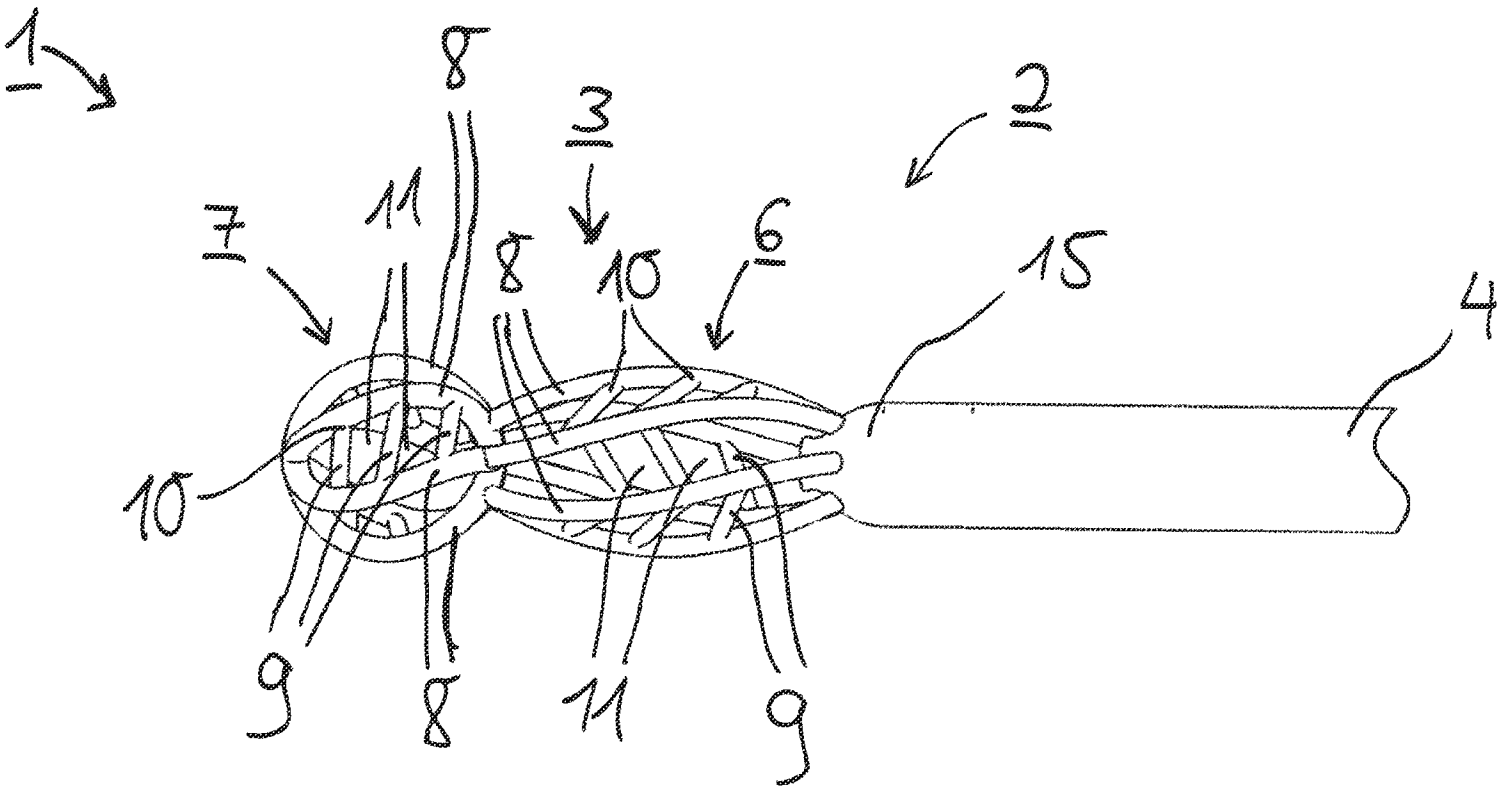
Figure 14:
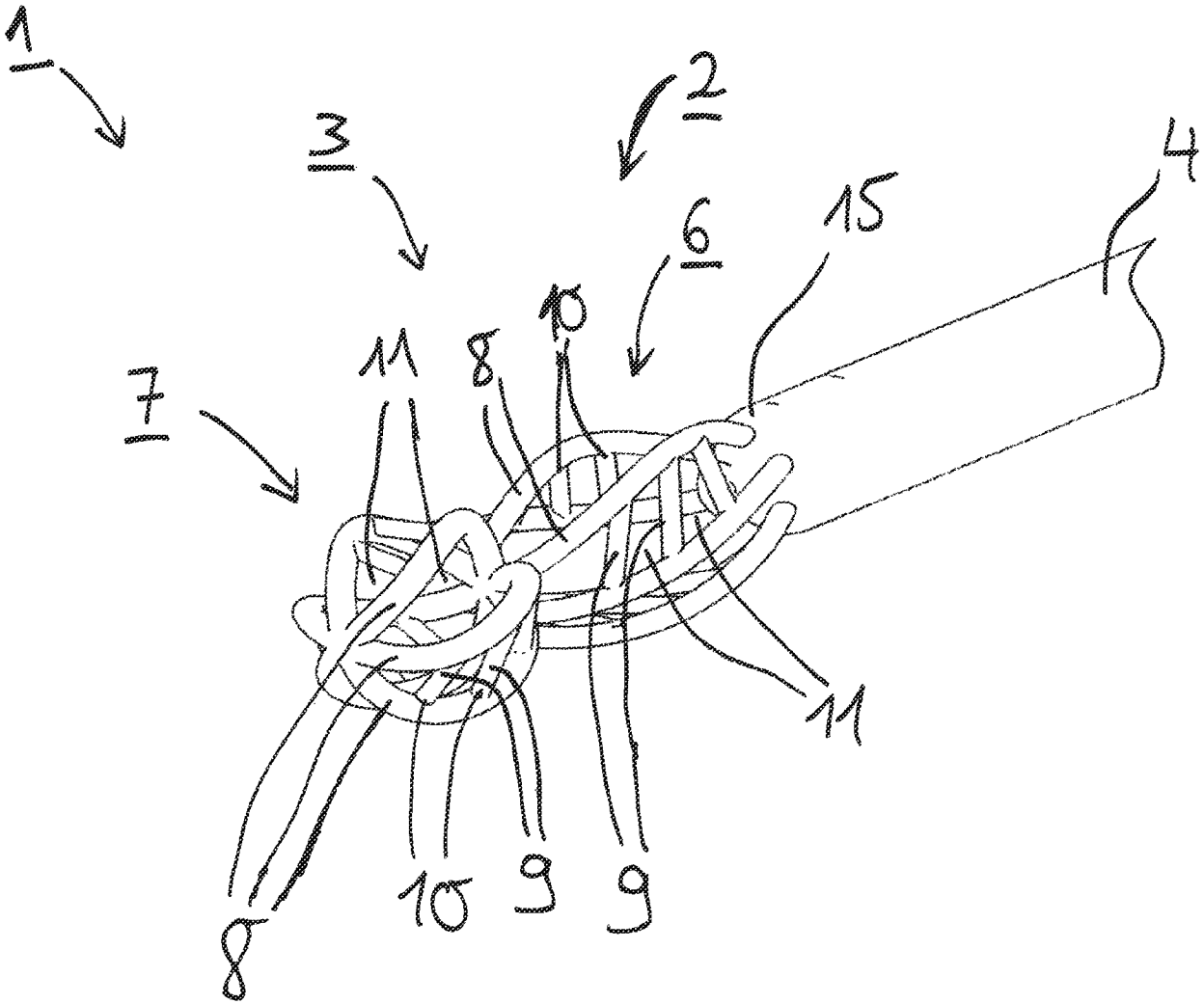

FIGS. 12 to 14 show applicators 2 whose applicator organs 3 each consist of two substantially or completely separate cage-like networks 6, 7.

The ribs 8 of the applicator organ 3 shown in FIG. 12 run in a spiral around the longitudinal axis L of the applicator organ 3, with the two networks 6 and 7, which are essentially separated from each other, being formed by the same ribs 8. The first network 6 is formed in which the radius of the spirals along which the ribs 8 run first increases continuously and finally decreases continuously again. The same applies to the second network 7. In the area of the transition between the network 6 and the network 7, the design is preferably selected or the spiral radius is thereby preferably so small that the fluid located inside the applicator organ 3 does not pass from one network into the other due to surface and interfacial tension. No connecting ribs are disposed between the ribs 8. Preferably, the networks 6 and 7 are designed to have more than insignificantly different elasticity. Ideally, this forms a two- or multi-stage dispensing applicator organ 3: The more voluminous, usually "wide-meshed" network 6 can first be deformed in the course of application so that it releases the predominant part of the fluid stored in its interior until the smaller, usually "close-meshed" network 7 releases the predominant part of the fluid stored in its interior.

The applicator organs 3 of the applicators 2 shown in FIG. 13 and FIG. 14 also consist of two networks 6 and 7. However, the first network 6 adjacent to the coupling part 15 has a plum-like shape; optionally, what was said for FIG. 8 can be applied here. The second network 7, on the other hand, forms a sphere. Here, optionally, what has been said for FIG. 9 or 10 can be applied. Connecting ribs 9 are disposed between the main ribs 8 of the two networks 6 and 7.

Figure 15:
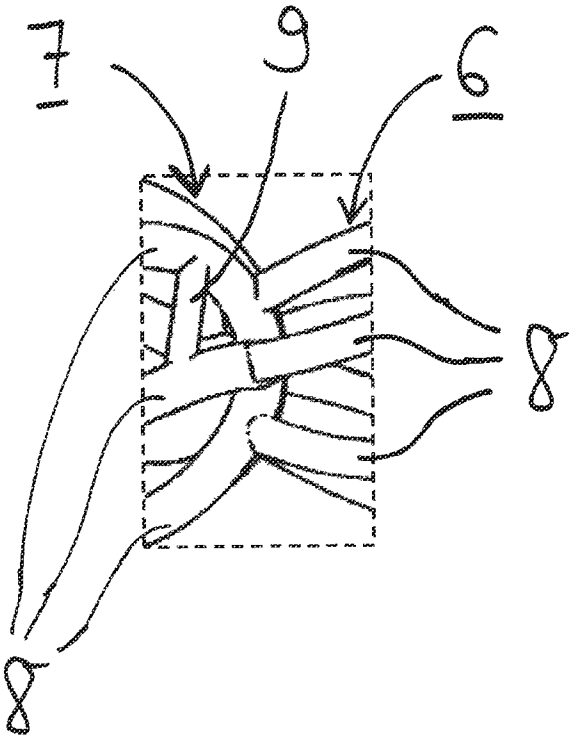
FIG. 15 shows the connection of two networks in a more detailed view.

FIG. 15 shows the transition area of an applicator organ 3 formed by two networks 6 and 7. It can be seen that the main ribs 8 of the first network 6 merge into the main ribs 8 of the second network 7.

Figure 16:
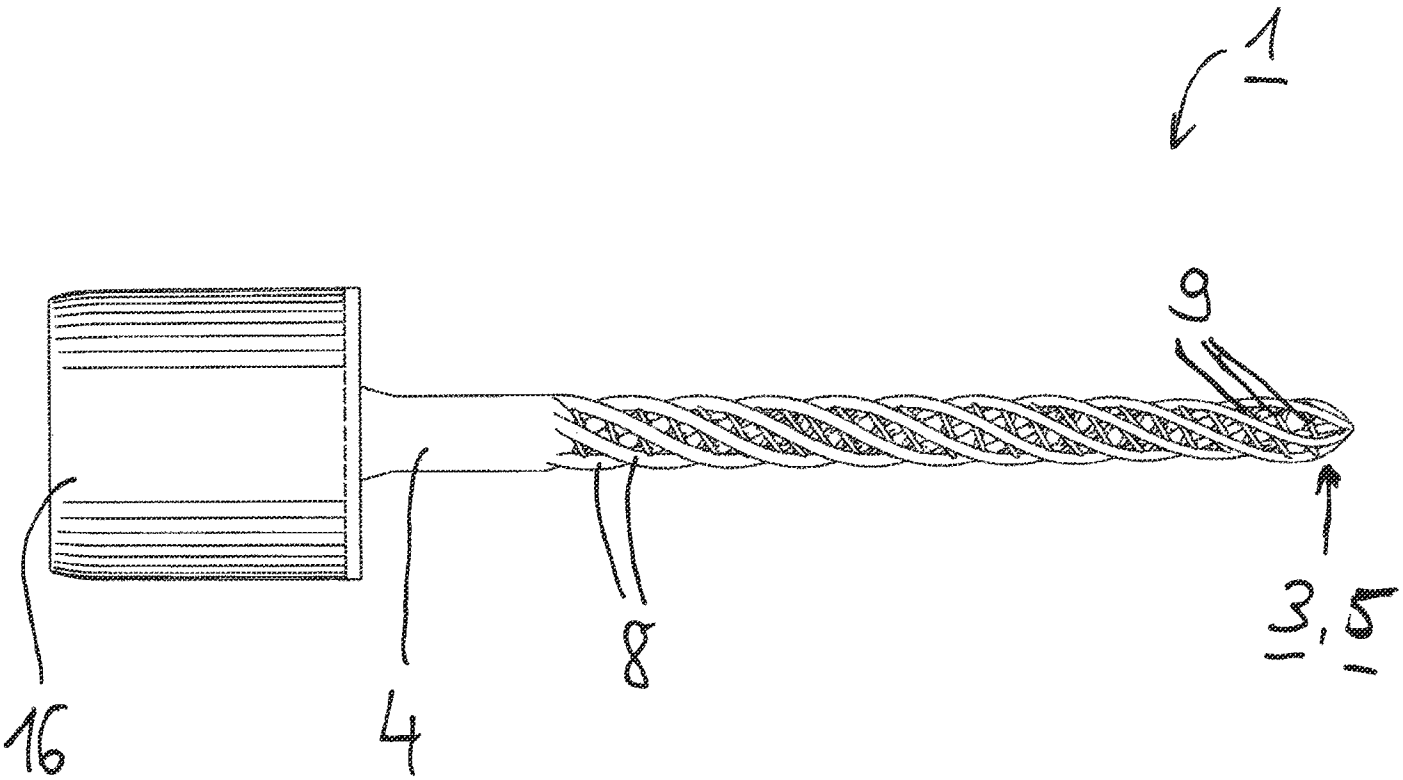
FIG. 16 shows an applicator unit with cylindrical network without bristles.

FIG. 16 shows an applicator unit 1 of the same type. In this, the network 5 forming the applicator organ 3 consists of the main ribs 8, which run helically with a constant radius around the longitudinal axis L of the applicator organ 3. In each case, several, usually two, main ribs 8, which generally screw parallel to one another, are connected by a plurality of connecting ribs 9. The connection can be ladder-like. In other words, each connecting rib 9 can form a kind of "ladder rung" which extends essentially perpendicular to the main rib areas it connects. In other cases, a connection can be more advantageous in which the connection is made at an angle, for example in that the longitudinal axis of the respective connecting rib 9 has an angle of approximately 45° to the local longitudinal axis of the main rib 8 in the connecting area of the connecting rib 9. Such a design facilitates springing in many cases. The stiffness of the applicator 2 can very advantageously also be adjusted by this. A noteworthy feature of this applicator 2 is that it is formed here by pairs of main ribs 8 which screw parallel to one another and are connected in pairs by connecting ribs 9. Adjacent pairs of ribs 8 are not connected to each other or are connected only to a lesser extent by connecting ribs 9. In this way, the applicator 2 shows at least one, completely free, spiral outlet groove and at least one spiral retaining area.

The outer diameter of the network 5 has predominantly a constant diameter. This is substantially the same size as the diameter of the stem 4. In the end of the applicator organ 3 facing away from the stem 4, the network 5 forms a dome. At the end of the stem 4 facing away from the applicator organ 3, the applicator unit 1 also has a handle 16 which has a corrugation.

Figure 17:
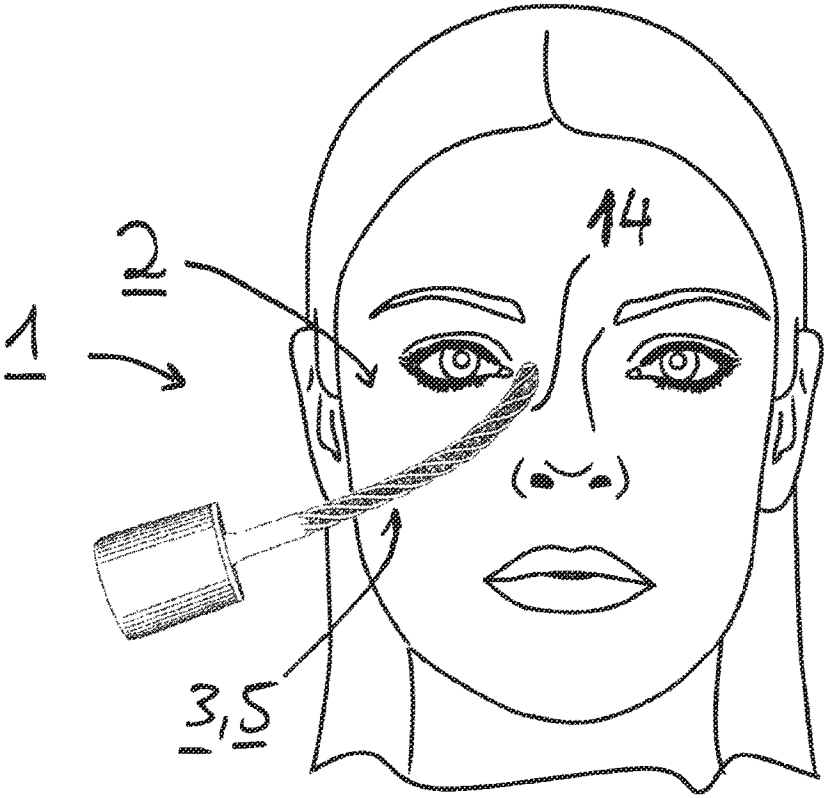
FIG. 17 shows one of the applicator units shown in FIG. 13 during application of fluid to the skin.

FIG. 17 shows how the applicator 2 shown in FIG. 16 or its applicator organ 3 deforms elastically when it is pressed against the surface 14 to be treated. Under bending load, the applicator organ 3 contracts in an accordion-like manner on its pressure side and elongates in an accordion-like manner on its tension side.

The surface 14 therefore can be a skin area, possibly also the outer circumferential surface of one or more hairs or a mucous membrane.

Figure 18:
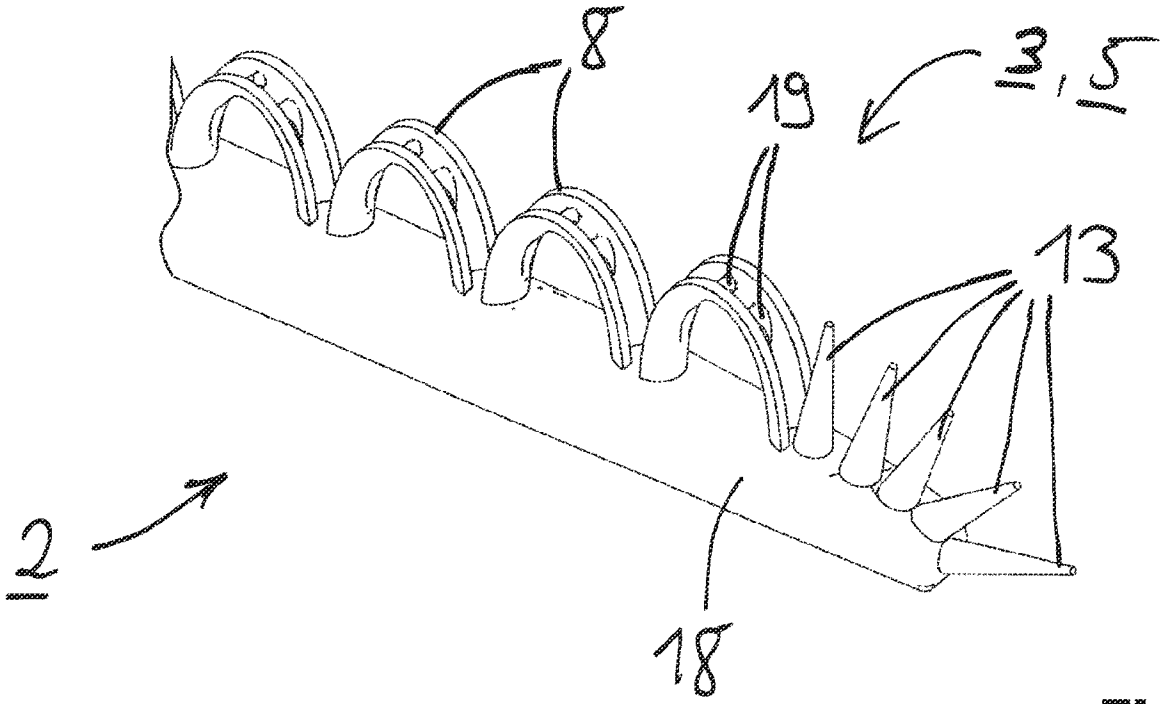
FIG. 18 shows an applicator unit with a network of ribs lined up in a straight line.
Figure 19:
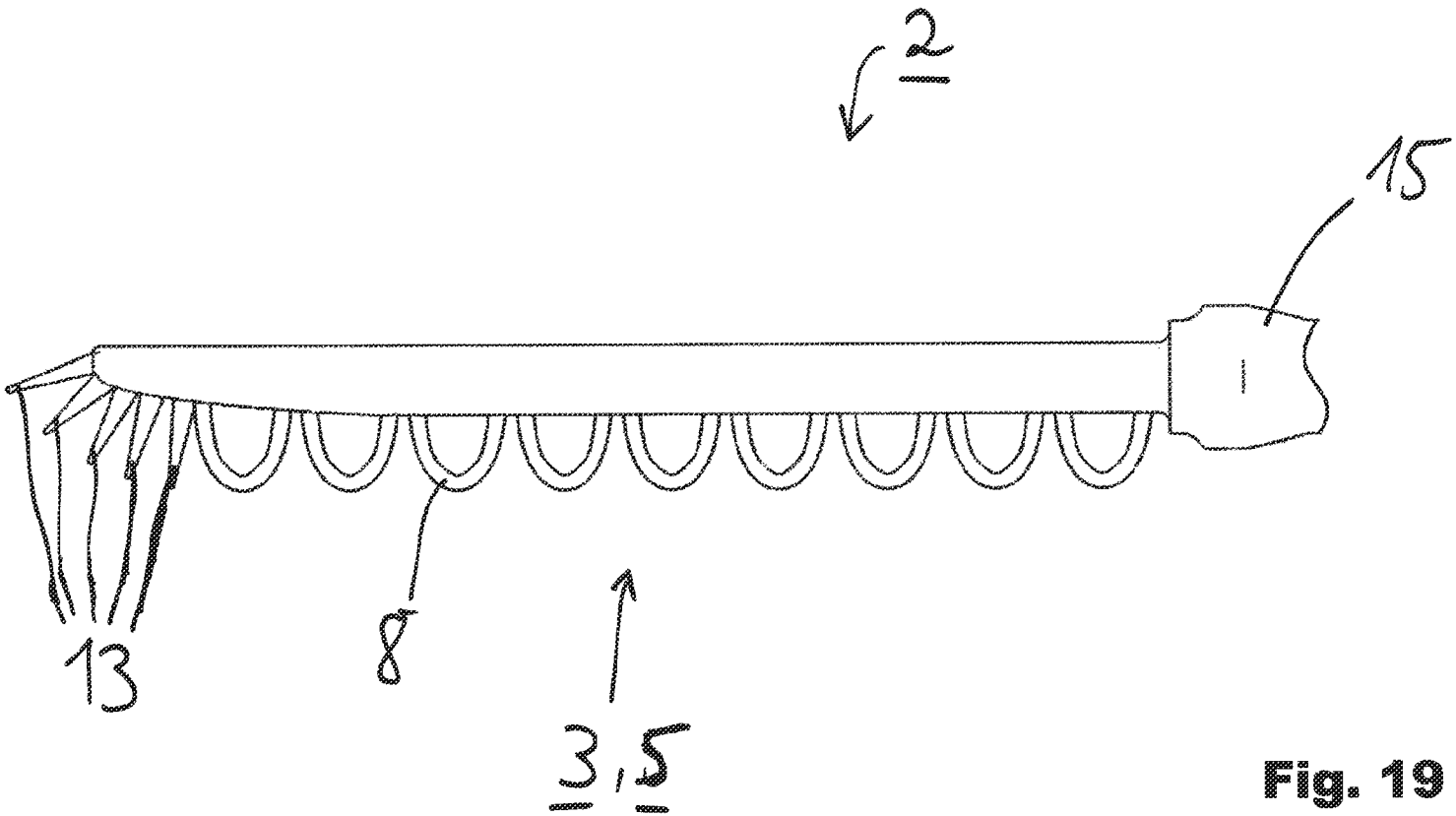
FIG. 19 shows a side view of the applicator unit according to FIG. 18.

FIG. 18 shows an applicator 2 of an applicator unit 1, the applicator organ 3 of which consists of a network 5 with semicircular ribs 8 arranged in a straight line. Accordingly, the interior space of the applicator organ 3, which receives the fluid, is not continuous. Rather, the interior space is formed by the regions enclosed between the semicircular ribs 8 and the support element 18 supporting them. The fluid is held in place by surface and interfacial tension of these areas. The ribs 8 include through-holes 19 on their side facing away from the support element 18, through which the fluid can escape from the regions between the ribs 8 and the support element 18 in the event of elastic deformation of the ribs 8. There are also five bristles 13 at the free end of the support element 18, but it is also conceivable to provide more or fewer bristles 13 on the support element 18. A side view of the applicator 2 is shown by FIG. 19.

Figure 20:
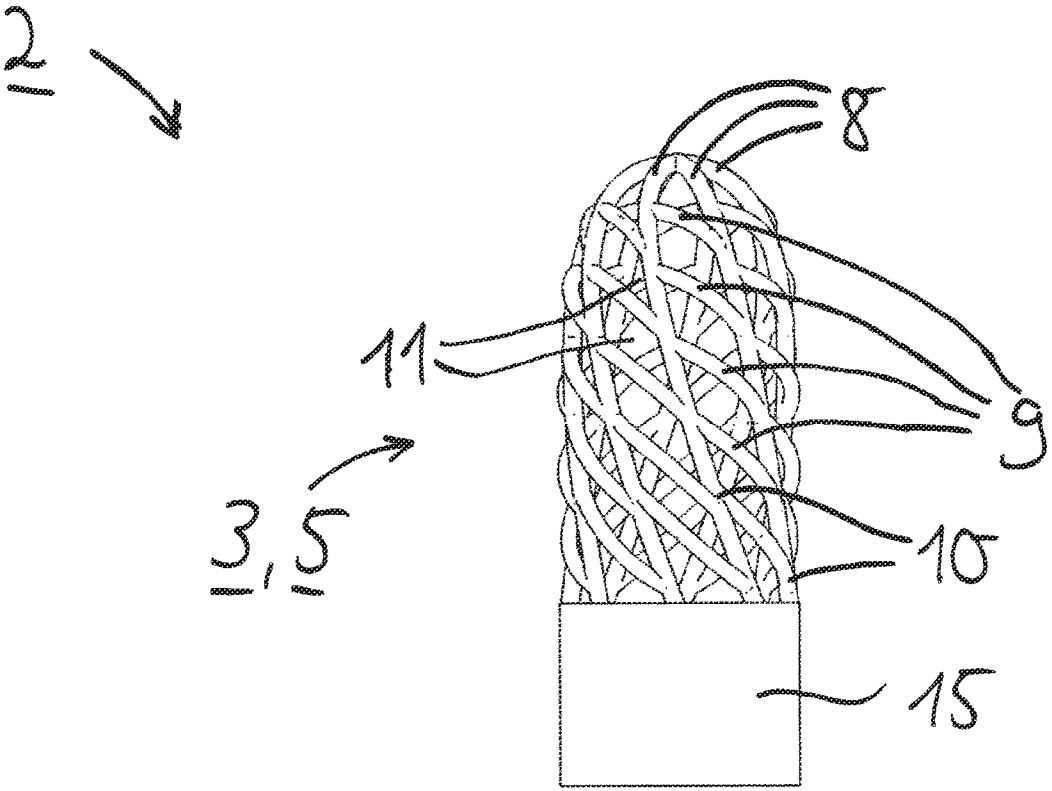
FIG. 20 shows an applicator of a further applicator unit without stem.

FIG. 20 shows an applicator 2 of an applicator unit 1 with an applicator organ 3, which is formed by a dome-like network 5. The dome-like network 5 is formed by several main ribs 8 running spirally around the not shown longitudinal axis L of the applicator organ 3 and additional connecting ribs 9. The outer diameter of the network 5 is predominantly constant starting from the coupling part 15. Only in the area of the free end of the applicator organ 3 does the diameter of the network 5 decrease in such a way that it closes the free end of the applicator organ 3 in the form of an elliptical paraboloid. The main ribs 8 and the connecting ribs 9 each have a circular cross-section with the same diameter.

Figure 21:
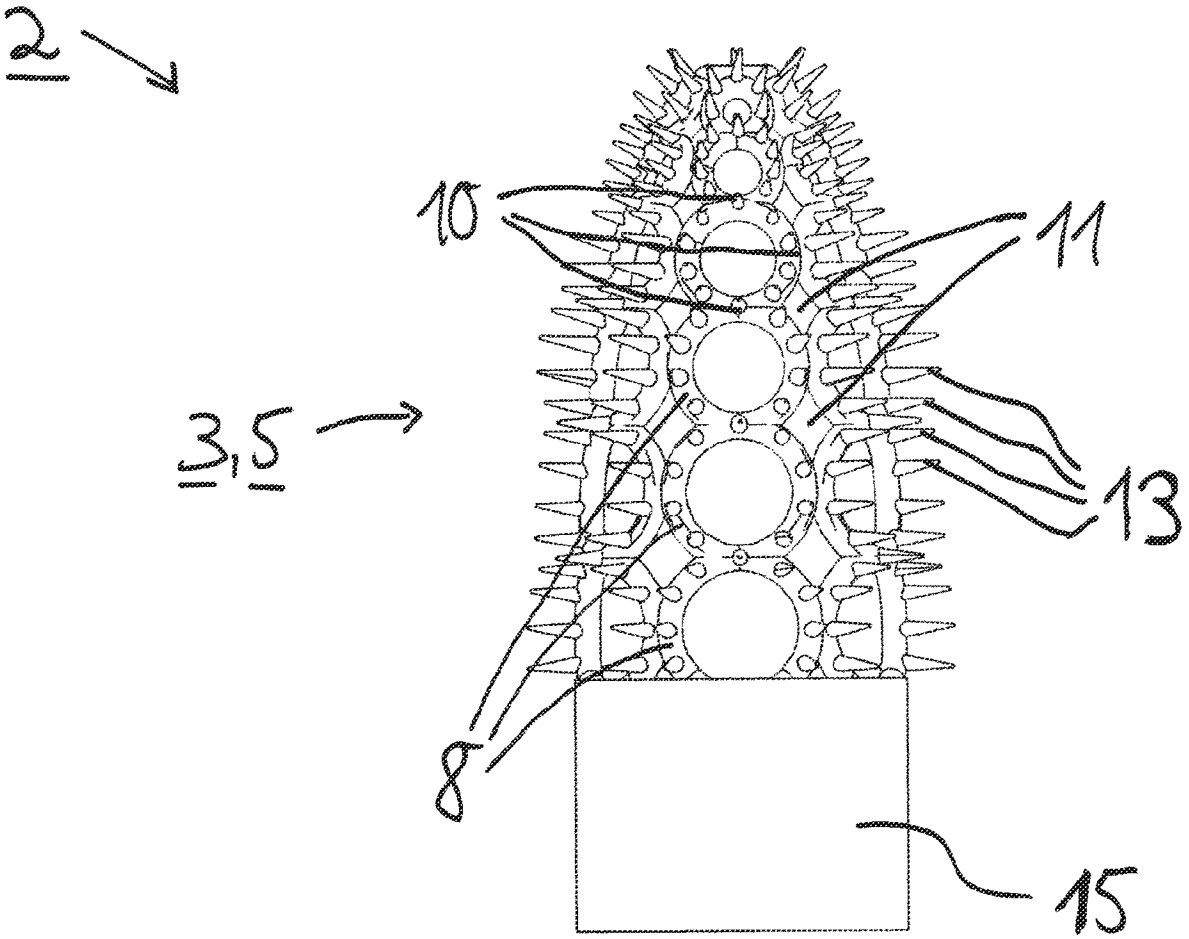
FIG. 21 shows an applicator of a further applicator unit without stem with a network consisting of annular ribs and bristles.

The network 5 of the applicator organ 3 of the applicator 2 shown in FIG. 21 consists exclusively of circular ribs 8, each circular rib 8 adjoining the respective adjacent circular ribs 8 in such a way that they merge into one another and form nodal points 10. Starting from the coupling part 15, the network 5 initially has a constant outer diameter. In the region of the end of the applicator organ 3 facing away from the coupling part 15, the diameter of the network 5 decreases in such a way that it closes the free end of the applicator organ 3 in the form of an elliptical paraboloid. The ribs 8 also include bristles 13 projecting orthogonally to the circular surface enclosing the respective rib 8. The bristles 13 taper to a point at their free end.

Figure 22:
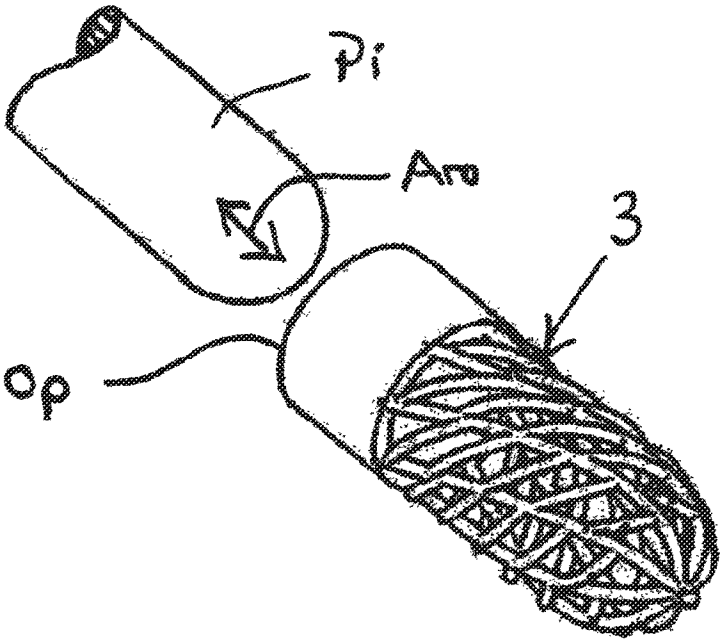
FIG. 22 shows another embodiment having an integrated help for fluid release and fluid absorption, for example in case of taking fluid samples.

FIG. 22 visualizes another embodiment having an integrated helping means for fluid release and fluid absorption.

The applicator organ is built according to the teaching and options disclosed by this patent specification. A difference from what has been disclosed before is that the proximal end of the applicator organ is "open", see the opening referenced as "Op". A moveable push rod or piston Pi, which can be guided in the interior of a hollow stem (not sketched here), can that way be pushed along the arrow referenced as "Aro" into the interior of the cage like application organ 3. That way the user has the option to enforce a complete or at least a predominant squeeze out of the agent or liquid that has been stored by now in the interior of the cage forming the application organ here. With other words the user has the choice to apply step by step little portions of the agent or fluid, for example by triggering deformation of the organ forming cage or to apply an enlarged or even defined dose of the liquid or agent stored in the cage by forcing the push rod into the interior of the applicator organ.

Special Area of Application

A very special field of application of the inventive applicator is the field of nasal decolonization.

An applicator designed for this special field includes an applicator tip adapted—mostly by having a lengthy, well rounded tip—for insertion into a nasal cavity and configured to store and release a fluid.

In particular but not only this type of applicator is characterized by exhibiting one or more of the following features The distal end of the applicator organ 3 has—at least partly—one of the following appearances: a conical outer shape, or an at least substantially conical outer shape, or a truncated cone shape, or an at least substantially truncated cone shape, or a rounded shape, an at least substantially rounded shape, or a spherical shape, or an at least substantially spherical shape, or an oval shape, or an at least substantially oval shape, or rounded edges and combinations of the foregoing, i.e. a shape which increases in size between the end and a middle portion of the application tip.

The applicator is preferably a 2K applicator, with the application organ 3 being formed from a first material and the support carrying the handle or being used as handle is formed from a second material.

The application organ is preferably formed from a high-density polyethylene, wherein the high-density polyethylene is optionally sintered and has a porous volume selected in the range of 40 to 60%, preferably in the range of 45 to 55%, with a pore size ranging in the range of 80 to 300 μm, in particular in the range of 100 to 250 μm.

The application organ preferably has a surface absorbability selected in the range of 10 to 30, in particular in the range of 15 to 26 $mm^2$.

Preferably the applicator organ 3 has an average value of Young's modulus selected in the range of 0.5 to 500 kPa, preferably in the range of 1 to 300 kPa, especially of 5 to 250 kPa; and/or wherein a hardness of a material of the applicator organ is selected in the range of 25 to 95, in particular of 40 to 60, measured on the Shore hardness scale A; and/or wherein a hardness of a material of the application tip is selected in the range of 35 to 50, in particular of 40 to 48, especially of 44 to 46, measured on the Shore hardness scale D, e.g. LDPE.

It can be in some cases a valuable variant if the applicator organ 3 comprises a foam or foam core having a density ranging from 30 $kg/m^3$ to 150 $kg/m^3$, and a porosity in the range of 60 ppi to 150 ppi.

In some cases it is preferred if an ethanol permeation time of at least a part of the applicator organ is in the range of 10 to 200 s, and a maximum diameter is 50 μm or more within the range of 1.0 mm×1.0 mm of the cross section.

Sometimes it is of use if the applicator organ comprises a polyurethane elastic body, —maybe in the shape of an encloses insert—containing 20 or more pores of 300 μm or less.

In some cases not only an applicator according to one or more of the aforementioned embodiments is claimed but an applicator unit is claimed that can comprise one of said applicators, a container forming a reservoir for the agent or liquid to be applied and optionally a handle for closing the container and for holding the applicator organ stowed in the container during times of non-use. Sometime a stem is comprised, too, which represents the interconnection between the applicator organ and the handle. In some cases the claimed applicator is filled with an agent or fluid ready for use.

The agent or fluid can comprise at least one of the following substances, a medical fluid, a dental fluid, a veterinary fluid, an antiseptic substance, an antihistamine, an glucocorticoid, epinephrine (adrenaline), a mast cell stabilizer, an antileukotriene agent, povidone-iodine (PVP-I), mupirocin, alcohol, jojoba, water, orange oil, lauric acid, benzalkonium chloride, vitamin E, hypothiocyanite, lactoferrin, N-chlorotaurine, interferon-alpha, povidone-iodine, quaternary ammonium compounds, alcohol-based nasal antiseptics, hydroxychloroquine, *galphimia glauca, luffa operculata, sabadilla* and combinations thereof.

Miscellaneous

When the time has come we also will (by division) claim protection for the following objects, independently each:

Applicator unit (1) with an applicator (2) and a fluid in the form of a flowable cosmetic or pharmaceutical to be applied to the skin or hair, with an applicator organ (3) which stores the fluid in its interior and which serves to distribute the fluid after its release, the applicator organ (3) being a hollow body with a wall (5) which delimits its interior and which is formed by a network (5) of locally interconnected ribs (8, 9) which are otherwise spaced apart from one another, otherwise spaced-apart ribs (8, 9), characterized in that the interior space and/or the network (5) are matched to the fluid for which the applicator is intended to be applied in such a way that the network (5) retains a certain amount of fluid in its interior space after being immersed in and withdrawn from a fluid supply and releases the retained fluid to the outside via the interstices (11) of the network (5), while the network is essentially stiff and does essentially not undergo a deformation (most preferred cases no deformation bigger than 0.5 mm or even not bigger than 0.2 mm) under the forces of regular application.

For further improvement of this claim it can be preferably merged with one, more or all those technical features that are disclosed by this application as a whole as long as these technical features do not concern the non-existing elasticity.

Protection is sought, too, for an applicator for use for a system of an applicator and a fluid as disclosed by this application.

For further improvement of the directly aforementioned claim it can be preferably merged with one, more or all those technical features that are disclosed by this application as a whole for the applicator regardless whether these technical features concern the elasticity or not.

The invention claimed is:

1. An applicator unit comprising:

an applicator and a fluid in the form of a flowable cosmetic or pharmaceutical to be applied to skin or hair, with an applicator organ which stores the fluid in an interior and is configured to distribute the fluid after release thereof, the applicator organ being a hollow body with a wall which delimits the interior and which is formed by a network of locally interconnected ribs, the interconnected ribs being spaced apart from one another, the interior space or the network being matched to the fluid for which the applicator is to apply such that the network retains a certain amount of fluid in the interior after being immersed in and withdrawn from a fluid supply and releases the fluid retained therein to an outside via interstices of the network when the network is deformed on contact with a surface to be treated, the network of locally interconnected ribs forming the applicator organ comprising:

main ribs extending at least in sections spirally or helically from a distal end toward a proximal end of the applicator organ, and connecting ribs, the network of locally interconnected ribs forming a cage which is closed at the proximal end and the distal end, a center of the applicator organ being completely hollow and free from ribs and at least one of bristles and a core.

2. The applicator unit according to claim 1, wherein the interconnected ribs of the applicator organ, outside nodal points where the interconnected ribs connect to one another, have a predominantly perpendicular cross section to a longitudinal axis thereof of less than or equal to 2.25 $mm^2$.

3. The applicator unit according to claim 1, wherein the network of interconnected ribs is configured to deform under bending load by each rib of the interconnected ribs pivoting elastically about a respective nodal point, which connects the respective interconnect rib to an adjacent rib of the interconnected ribs.

4. The applicator unit according to claim 3, wherein the network of interconnected ribs is configured such that, under bending load, the network is capable of being pushed together in an accordion-like manner on a pressure side and pulled lengthwise in an accordion-like manner on a tension side.

5. The applicator unit according to claim 1, wherein the network extends at least in sections spirally from the distal end toward the proximal end of the applicator organ, and the interconnected ribs are configured to be elastically deformed by contact with the surface to be treated such that a spiral angle increases and changes a retention capacity of the applicator organ such that at least part of the fluid retained is discharged to the outside.

6. The applicator unit according to claim 5, wherein at least a portion of the interconnected ribs forming the network have a longitudinal rib axis which has a spiral angle with respect to a longitudinal axis of the applicator organ.

7. The applicator unit according to claim 1, wherein the cage is closed at the distal end by the interconnected ribs converging towards a longitudinal axis of the applicator organ and merging with one another.

8. The applicator unit according to claim 1, wherein the main ribs have a mean diameter that is greater than a mean diameter of connecting ribs of the interconnected ribs that extend only from a nodal point on a first main rib of the main ribs to a nodal point on a second main rib of the main ribs.

9. The applicator unit according to claim 8, wherein the main ribs bear bristles which protrude outwards in a substantially radial direction.

10. The applicator unit according to claim 1, a surface of the interconnected ribs of the applicator organ has a roughness or texture which can be seen with a naked eye or felt with a fingernail in a cleaned state.

11. The applicator unit according to claim 1, wherein at least part of the interconnected ribs bear bristles which protrude outwards in a substantially radial direction.

12. The applicator unit according to claim 1, wherein the wall formed by the network of locally interconnected ribs has an outer diameter equal to or substantially equal to an outer diameter of an adjoining stem.

13. The applicator unit according to claim 1, wherein the wall has a spherical shape.

14. The applicator unit according to claim 1, wherein the network is one of a plurality of cage-like networks hydraulically substantially separated from one another.

15. The applicator unit according to claim 1, wherein the interconnected ribs form circular rings, oval rings or polygonal rings, which are connected to one another at their outer circumference via nodal points.

16. The applicator unit according to claim 1, wherein the interconnected ribs of the applicator organ, outside nodal points where the interconnected ribs connect to one another, have a predominantly perpendicular cross section to a longitudinal axis thereof of 1.44 $mm^2$, the interconnected ribs being shaped so as to have a free length between nodal points that is greater than 2.5 times, a mean rib diameter, and openings located between the interconnected ribs being shaped to have a clear area that is greater than 4 $mm^2$.

17. The applicator unit according to claim 1, wherein the cage is closed at the distal end by the interconnected ribs converging towards a longitudinal axis of the applicator organ and merging with one another to form of a pointed basket having a release pin at a tip thereof, openings between the interconnected ribs decreasing in size towards the tip so that the fluid being discharged is capable of being controlled by how the applicator organ is held with respect to a longitudinal axis thereof when vertical or deviated more or less from vertical.

18. The applicator unit according to claim 1, wherein the network is first network of a plurality of cage-like networks hydraulically substantially separated from one another, the first network being an elongated cage having plum-like design and a second network of the plurality of cage-like networks is a cage of spherical design which adjoins the first network at the distal end.

19. A cosmetic or pharmaceutic unit comprising:

the applicator unit according to claim 1 and the fluid to be applied; and a container for storing the fluid to be applied and storing the applicator unit in an interior of the container, when the cosmetic or pharmaceutic unit is not in use.

* * * * *